US008939102B2

(12) United States Patent
Hall

(10) Patent No.: US 8,939,102 B2
(45) Date of Patent: Jan. 27, 2015

(54) DOOR FRAME SEALS

(75) Inventor: Alan John Hall, Sheffield (GB)

(73) Assignee: Marine Systems Technology Limited, Cheshire, CW (GB)

( * ) Notice: Subject to any disclaimer, the term of this patent is extended or adjusted under 35 U.S.C. 154(b) by 54 days.

(21) Appl. No.: 13/641,010

(22) PCT Filed: Apr. 12, 2011

(86) PCT No.: PCT/GB2011/050720

§ 371 (c)(1),
(2), (4) Date: Oct. 12, 2012

(87) PCT Pub. No.: WO2011/128677

PCT Pub. Date: Oct. 20, 2011

(65) Prior Publication Data

US 2013/0025520 A1 Jan. 31, 2013

(30) Foreign Application Priority Data

Apr. 12, 2010 (GB) ..... 1006030.9

(51) Int. Cl.
*B63B 19/00* (2006.01)
*B63B 19/08* (2006.01)
*B63B 19/18* (2006.01)

(52) U.S. Cl.
CPC ..... *B63B 19/00* (2013.01); *B63B 19/08* (2013.01); *B63B 19/18* (2013.01)
USPC ..... 114/117

(58) Field of Classification Search
USPC ..... 114/117
IPC ..... B63B 19/00,19/26
See application file for complete search history.

(56) References Cited

U.S. PATENT DOCUMENTS 4,104,830 A * 8/1978 Eagle ..... 49/468
4,352,258 A * 10/1982 Bursk et al. ..... 49/468
7,210,421 B1 * 5/2007 Pendergraph ..... 114/78

FOREIGN PATENT DOCUMENTS

CN 201056955 7/2007
CN 201240496 5/2009

(Continued)

OTHER PUBLICATIONS

GB1006030-9 Search Report dated Jun. 8, 2010.

(Continued)

*Primary Examiner* — Stephen Avila
(74) *Attorney, Agent, or Firm* — Jeffrey G. Sheldon; Leech Tishman Fuscaldo & Lampl

(57) ABSTRACT

A watertight door system for a marine vessel comprises a door and a door frame having a threshold. A circumferential seal is around an opening of the door frame closed by the door. The seal is formed between seal components of the door and seal components of the door frame. The frame is adapted for connection to the bulkhead and comprises two sides, a top member and a floor trough. Means are provided to press the door against the frame when the door is in a closed position. The trough has a floor plate substantially flush with a top edge of the trough, which floor plate is adapted to form a floor panel of the floor of the vessel, with said trough received in an aperture of the floor. The trough has a lid to close the trough, at least when the door is in an open position, so that the floor is rendered substantially level through the door aperture. The seal may extend along the lid (in the case of a pivoting door) or in the trough, in the case of a sliding door.

46 Claims, 17 Drawing Sheets

(56) References Cited

FOREIGN PATENT DOCUMENTS

| | | | |
|---|---|---|---|
| DK | 167289 | B1 | 10/1993 |
| GB | 764782 | | 1/1957 |
| GB | 1158472 | | 7/1969 |
| GB | 1249421 | | 10/1971 |
| GB | 2364731 | B | 6/2002 |
| JP | 10037626 | A | 2/1998 |
| SU | 474462 | | 6/1975 |
| SU | 1291485 | A1 | 2/1987 |
| WO | WO9214901 | A1 | 9/1992 |
| WO | WO2009008749 | A1 | 1/2009 |

OTHER PUBLICATIONS

PCT/GB2011/050720, Written Opinion and Search Report dated Nov. 22, 2011.

PCT/GB2011/050720 International Preliminary Report on Patentability dated Oct. 16, 2012.

* cited by examiner

DOOR FRAME SEALS

The present application is the national phase of International Application No. PCT/GB2011/050720, titled "Door Frame Seals", filed on Apr. 12, 2011, which claims the benefit of priority to Great Britain patent application No. 1006030.9, filed on Apr. 12, 2010. The entire disclosure thereof is incorporated herein by reference.

This invention relates to a door frame sealing arrangement, in particular for marine vessels requiring all-round seals to render the door watertight, to seal from flooding a compartment accessed by the door.

BACKGROUND

Watertight doors are a common safety feature of marine vessels. As in land based situations, doors may be pivoted on hinges, normally about a vertical axis, or they may be sliding. Sliding doors are particularly desired in marine vessels in cases where a lift opens onto a deck and it is desired not to obstruct a passageway that extends transversely of the lift immediately outside the lift exit. However, they are not limited to such situations and can be desirable wherever a passageway extends transversely to a compartment accessed by a doorway. However, pivoted doors remain also important where a passageway only extends longitudinally or where there is no disadvantage in the door panel swinging into a space accessed by the door, which is frequently the case.

Indeed, swinging doors are much less complex to install and do not need a wall space to one side of the door in which a sliding door is stowed when open. Such swinging doors in marine vessels normally comprise a peripheral lip of a frame for the door and against which the door seals when closed. Conveniently, the seal is in a single plane, normally, although not exclusively, in the vertical plane with elements serving to press the door against the frame seal. Hydrostatic pressure (in the case of flooding) on the door side of such a frame generally assists maintenance of the seal, but frequently the ability to seal in both directions is needed (ie, also if the flooding is on the bulkhead side of the door). In that event, lock members are needed to hold and press the door against the frame seal, and be sufficiently strong to resist water pressure that may be pressing against the frame side of the door attempting to open it. In either case, the seal needs to react against the pressure applied by the lock elements and potentially also against hydrostatic pressure of flood water. Conveniently, the seal is formed on a circumferential flange disposed around the door frame that serves to provide a rigid edge that is unlikely to deflect and open a leak path. Such a circumferential flange, however, needs to be raised above a floor level because, generally, a bottom edge of the door needs to press against the seal and is generally opened in a direction transverse to the seal, requiring the door itself to have some clearance above the floor. This means that a step is inevitably formed in the doorway opening above floor level. This makes access through the door problematic for wheeled vehicles. Since watertight doors may frequently be required in parts of vessels needing vehicular access, this represents an obstacle.

DK-1450/91, GB-A-1158472, GB-A-764782, JP-A-10-37626 and GB-A-2364731 all disclose door frame sills that have vertically displaceable seals that seal against the underside of a door and which are deflectable downwardly when, for example, a wheel overrides the seal. However, such arrangements are only effective for the purpose of excluding adverse weather, and are not watertight for the purpose of resisting flood.

WO-A-2009/008749 discloses a similar arrangement except that the seal element is selectively withdrawn and raised. The seal is arranged transverse to the door opening direction but is nevertheless only a weather seal and is not watertight, at least not against flood water.

Returning to sliding doors, the same problem exists. In order to provide a seal, this can only reliably be achieved by a circumferential seal between the door and frame and against which the door is pressed when closed. This pressing is in a direction transverse, indeed, most likely orthogonal, to the normal opening movement of the door. Thus the frame requires a circumferential lip against which the door can press and this results in the need for a step in the doorway. Furthermore, sliding doors present difficulties in resisting anticipated loads against the door when closed, particularly hydrostatic pressure of flood water on the frame side of the door. Rendering the door panel itself sufficiently rigid is not problematic, but holding it reliably in place is not straightforward.

Another issue with marine doors, both sliding and pivot-opening, is the need to resist fire. This also applies in both directions (at least, in some instances). Furthermore, not only is there the necessity to hold back a fire, but there is also the desire for a door to remain operational after a fire. Of course, there are limits to the operational functionality of any door system, but there are presently defined fire standards which door systems need, on occasions, to meet. Such standards may change, but a fire standard presently applicable for many marine vessels is A60 set under the International Convention for the Safety of Life at Sea (SOLAS), 1974 by the International Maritime Organisation (IMO). This standard requires a door to resist a fire on one side of the door that reaches temperatures of 1500° C., and for a period of at least one hour. The resistance to the fire is not just in respect of heat, but of course also in respect of gases, whether hot or toxic, within the fire environment that must remain confined thereto.

It is an object of the present invention to provide a door seal arrangement that is effective for a watertight door and convenient for vehicular access through the door. It is an object also to provide a fire resistant door that meets current standards.

BRIEF SUMMARY OF THE DISCLOSURE

In accordance with a first aspect of the present invention there is provided a door system for connection to a marine vessel bulkhead around an aperture in the bulkhead, the system comprising:

a) a frame adapted for connection to the bulkhead and comprising two sides, a top member and a floor trough;
b) a door comprising a structural panel and having a bulkhead side adapted in use to face the bulkhead and an opposing door side facing away from the bulkhead;
c) the top member including a track having depending supports of the door;
d) a side channel on a first side of the frame;
e) a lip on the second side of the frame;
f) the door having a first side edge adapted to engage said side channel when the door is slid along said track to a closed position of the door;
g) the door having a door channel around its second edge, which channel is open on the bulkhead side of the door, whereby the open door channel engages said lip when the door is slid along said track to said closed position of the door;
h) a circumferential seal between the door and the frame; and i) a cam to press the door against the frame to effect the seal, the cam being operated when the door is slid along said track to said closed position of the door; and wherein j) said side channel and door channel are reinforced so as to accommodate pressure loads on the bulkhead side of the door tending to push the door off the seal.

The term "seal" as used herein, unless the context dictates otherwise, means the interaction between the door and frame causing a seal to be formed between them. Thus, it refers to elements of both the door and the frame, and usually means a resilient element on one and an abutment surface on the other against which the resilient element is pressed to effect the seal. However, when referring to the "seal", the context may include a reference to just one side of the seal (door-side or frame-side), and being either the resilient element or its abutment face. Indeed, "abutment face" might actually mean an edge of a component.

Preferably, the seal is adapted to seal against hydrostatic pressure on either side of the door. The seal may include a resilient element having a back surface for fixation of the seal element against the frame or door and two depending lips adapted to engage the bulkhead side of the door or the frame, one lip extending in a direction that resists hydrostatic pressure from the bulkhead side of the door and the other lip extending in a direction that resists hydrostatic pressure from the door side of the door. Preferably, the seal element is fixed to the frame and the door has a peripheral rim for engagement with the seal.

Preferably, said side channel and door channel are each reinforced by a plurality of U-shaped plate fillets welded around the outside of the channel at spaced locations along each channel. By this means the channels themselves can be constructed of relatively thin material and yet be provided with the requisite rigidity.

Preferably, said channels each have at least one inclined side edge that constitutes said cam. The door channel may have said inclined edge on the side of the channel that engages said lip when the door slides towards its closed position, so that, when said lip engages said inclined side, the door channel and door are together drawn towards the frame to effect said seal. The side channel may have said inclined edge on a side of the channel that engages said side edge of the door when the door slides towards its closed position, so that, when said side edge engages said inclined side, the door is drawn towards the frame to effect said seal.

In a second aspect, the present invention provides a door system for connection to a marine vessel bulkhead around an aperture in the bulkhead above a floor of the vessel, the system comprising:

a) a frame adapted for connection to the bulkhead and comprising two sides, a top member and a floor trough;

b) a door comprising a structural panel and having a bulkhead side adapted in use to face the bulkhead and an opposing door side facing away from the bulkhead;

c) the top member including a track having depending supports of the door; and a circumferential seal on one of the door and frame adapted to engage the other of the frame and door, wherein d) said structural panel comprises a bulkhead skin, a door skin spaced from the bulkhead skin and an edge skin extending around the door, reinforcing ribs bracing said bulkhead and door skins against one another;

e) a rim, including said edge skin, around the edge of the door panel and defining both the width of the door and at least a bulkhead face of the rim, which face is of a width sufficient to overlie said seal;

f) said bulkhead skin is inset within said rim to receive a fire resistant door board; and g) said sides and top member of the frame have fire resistant frame boards whose edges are adjacent said seal when the door is slid along said track to said closed position of the door and are adapted to define with said door board an inaccessible heat path.

Thus, when the door is closed and said seal effected, a gap remains between the edges of said frame boards and the face of the door board, but this gap is arranged to be as small as possible without risking that the frame boards prevent proper effect of the seal. Nevertheless, the gap, if it is less than about 2 mm in width, represents a sufficient barrier to transmission of heat from the bulkhead side of the door to the seal to protect the seal and prevent its disruption in the event of a fire on the bulkhead side. The thickness of said frame boards, that define the length of the inaccessible heat path, are preferably at least 20 mm. The frame boards preferably extend around the sides and top of the frame only, the floor comprising a separate and independent fire capability not within the context of the present invention.

In a third aspect, the present invention provides a door system for connection to a marine vessel bulkhead around an aperture in the bulkhead near a floor of the vessel, the system comprising:

a) a frame adapted for connection to the bulkhead and comprising two sides, a top member and a floor trough;

b) a door comprising a structural panel and having a bulkhead side adapted in use to face the bulkhead and having an opposing door side facing away from the bulkhead;

c) a circumferential seal between the frame and door; and d) means to press the door against the frame when the door is in a closed position thereof; and wherein e) said trough comprises a floor plate substantially flush with a top edge of the trough, which floor plate is adapted to form a floor panel of the floor of the vessel with said trough received in an aperture of the floor, the trough comprising a lid to close the trough at least when the door is in an open position so that the floor is rendered substantially level through the door aperture.

The trough may include a channel for receipt of a bottom edge of the door, which in this event opens by sliding in said channel.

The seal preferably extends into the trough, at least when the door is in an open position. In this event, the door may open by pivoting on hinges, but it may also slide. The seal may at least in part be on the lid, in which event it is split along its length between being disposed between the lid and the door and the frame and the door. In this event, the frame-side seal on the lid and frame align when the lid is open. The seal here means not just a resilient seal element disposed on one of the door and frame but also an abutment element of the other of the door and frame against which the seal element is pressed to effect the seal.

The trough and floor plate are preferably reinforced so that they can integrate with the floor of the vessel without compromising the integrity of the structure of the floor. By this meant that the floor through a bulkhead in a vessel has a requisite structural function in the overall design of the vessel and said reinforcement of the floor plate and trough should be such that, when installed in the vessel, the floor performs no less of its structural function than if the floor extended though the bulkhead without having the floor aperture formed therein for reception of the door trough and floor plate. Preferably, said trough is reinforced by a plurality of U-shaped plate fillets welded to the trough and spaced along its length. By this means the trough itself can be constructed of relatively thin material and yet be provided with the requisite rigidity. The fillets thus have side legs joined by a base to form said U-shape. Preferably, the plate fillets are also welded to the floor plate adjacent the trough and also reinforce the floor plate. In that event, the U-shape is modified by arms that extend horizontally from the free ends of the legs.

As used herein, the terms horizontal, vertical, up, down etc refer to attitudes of the systems described with these terms as they would normally be employed when installed and in normal operation. This aspect of the invention therefore has application whether the door is a sliding door or a pivoted door.

In a fourth aspect, the present invention provides a door system comprising:

a) a doorframe having a threshold defining a floor plane of the door system;

b) a sill member of the threshold including a seal and disposed in a slot in the threshold;

c) a door having a face to press against the seal in a first direction;

d) the sill member being pivotable in the threshold about an axis transverse said first direction between a first position in which the door, when closed, seals against the sill member and a second position in which the sill member does not extend above said floor plane.

The term "does not extend above said floor plane" should be understood to mean that the sill member does not extend above the floor plane so as to obstruct wheeled vehicles and foot traffic normally intended to pass through the doorway. Preferably, said sill member has said seal in a front-face thereof, an opposite back face lying in said floor plane in said second position.

Preferably, said sill member is L-shaped in section, a first arm comprising said front and back faces and a second arm comprising a floor seal which, in said first position forms a seal against a seal face of the threshold.

Preferably, both said seals are in the angle of the L-shaped sill member, said front face of the sill member having a top edge lying on an edge of the threshold opposite the seal face of the threshold.

Preferably, said threshold is a floor plate having a trough formed therein and in which said sill member is pivotable, selectively operable means being provided in the floor plate to pivot the seal member between said positions. Preferably, the trough is sealed to the floor plate around the entire periphery of said slot.

Preferably, selectively operable lock means are operable to press the door against the threshold seal and lock the sill member in said first position Preferably, closure of the door against the sill member serves to hold the sill member in said first position.

Preferably, the door includes lock devices that press the door against the sill member, said lock devices pressing on said opposite back face.

Preferably, a door seal is provided all around the door to render the door watertight when closed, the sill member forming a part of said door seal when in said first position. Conveniently, said door seal lies in a single plane.

Preferably, said door seal comprises an edge of one of said door and door frame and a resilient face of the other of said door and door frame. Preferably, said edge is an edge of a flange of the door frame and sill member.

Preferably, the edge of the sill member is a seal plate that is supported on a support element upstanding from said second arm and positioned by a plurality of fillets disposed between said first arm and said support element, the fillets being slotted to receive said seal plate.

Preferably, a further support element is disposed on the seal plate and also supported by said fillets, said lock devices operating against said further support element.

Preferably, said door system is for a marine vessel, forming a watertight door.

In a fifth aspect, the present invention provides a watertight door system for a marine vessel comprising a door and a door frame having a threshold, a circumferential seal around an opening of the door frame closed by the door, which seal is formed between seal components of the door and seal components of the door frame, an upstanding flange of the threshold forming a part of the seal components of the door frame, said flange being selectively displaceable between an operable position in which the door and door frame seal components can seal against one another to render the door watertight and an open position in which said threshold has a substantially flush top surface.

Preferably, said watertight door system is a door system in accordance with at least one of the earlier aspects of the present invention.

Thus the invention provides a door system, particularly for a marine vessel that is capable of forming a watertight seal but also permitting the threshold floor of the door frame to be rendered essentially flush with the surrounding floor of the vessel so that wheeled vehicles can pass through the door without hindrance from a step normally associated with watertight doors of marine vessels. The invention has primary application in two areas. A first is in naval vessels where munitions are to be transported between compartments of the vessel, potentially while at sea. The second is in cargo vessels where compartments require to be loaded and unloaded of cargo to and from compartments of the vessel while at port. However, there are many other cases where it is convenient to have the facility to drive vehicles (eg fork lift trucks) unimpeded through doorways in marine vessels that, when closed, are required to be watertight. The present invention provides an effective solution. Furthermore, with current regulations and good practice, such doors cannot only be rendered watertight but also fireproof, and fireproof to the extent that, after a defined fire (that is, one within the standards laid down such as standard A60 of the IMO) the door remains functional.

BRIEF DESCRIPTION OF THE DRAWINGS

Embodiments of the invention are further described hereinafter with reference to the accompanying drawings, in which.

DETAILED DESCRIPTION

Figure 1:
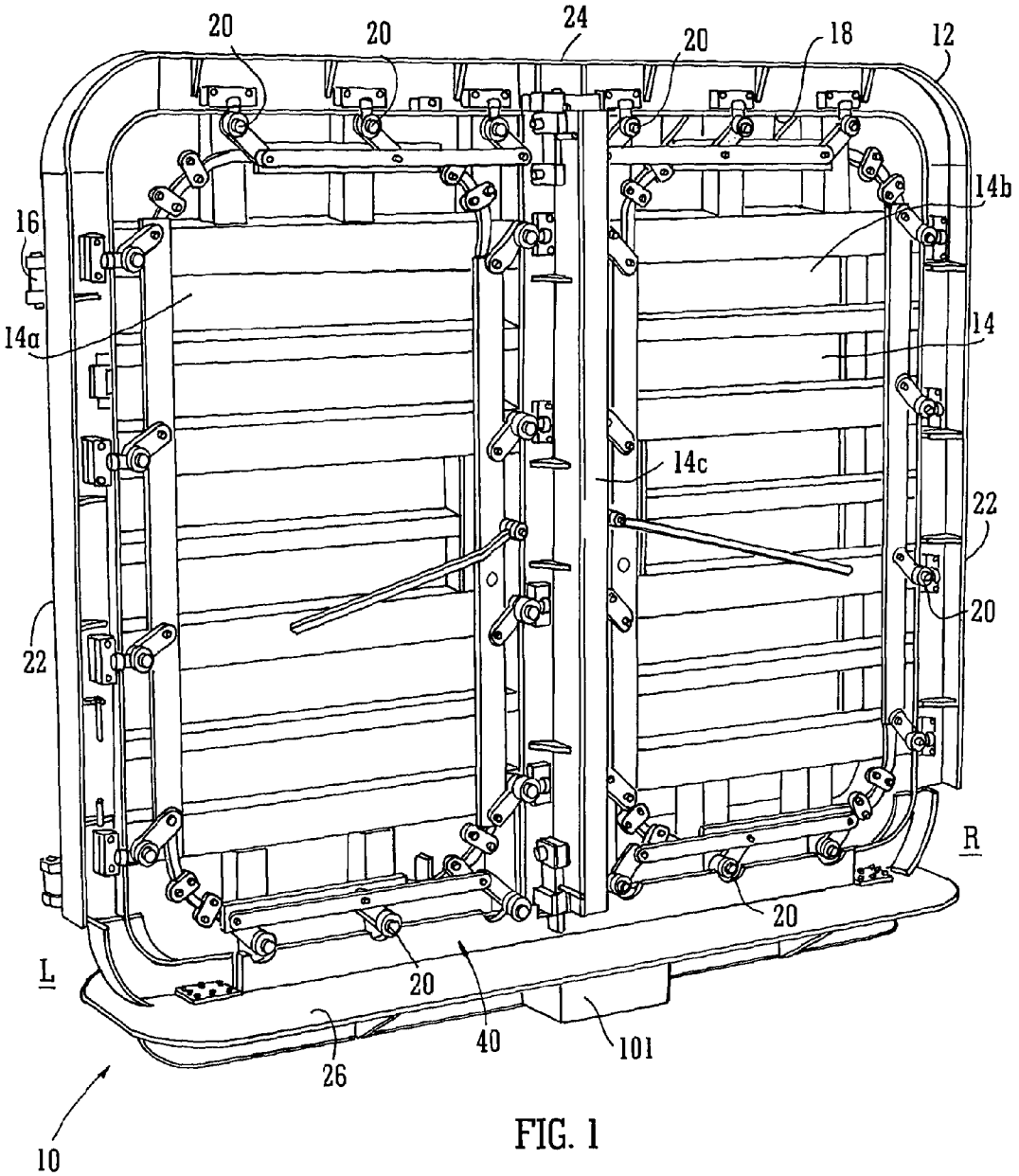
FIG. 1 is a perspective view of a door system for a marine vessel and in accordance with a first embodiment of the present invention.

In FIG. 1, a door system 10 for a marine vessel comprises a doorframe 12 and a door 14. Here, the door 14 has two wings 14*a,b* each hinged to the frame 12 about hinges 16 (only one side being visible). However, the door otherwise plays no significant role in the operation of the invention and could be organized in other ways. For example, it could be pivoted from above or be disposed on a slide mechanism. In the drawing, the door wings 14*a,b* open through the opening 18 of the doorframe 12 into the plane of the drawing. Door locks 20 around the door serve to latch the door wings 14 against the far side of the frame 12.

The frame 12 comprises vertical side elements 22, roof element 24 and threshold 26. In FIGS. 2 and 3, threshold 26 comprises a floor plate 28 and trough 30 which extends the full width of the door 14 and the opening 18 therefor in the frame 12.

The floor plate 28 has a rectangular slot 32 that also extends along the majority of the width of the opening 18. Hinge plates 34 are secured to the floor plate 28 at either end of the slot 32 and support an L-sectioned sill member 40. The sill member 40 has two legs 42,44 disposed substantially at right angles to one another. In the position shown in FIGS. 3*b* and 4, the leg 42 spans the width of the slot 32, substantially closing it and lying flush with the floor plate 28. Indeed, the slot 32 is provided with an inset ledge 46 on which the end 48 of the leg 42 rests. The axis of the pivot formed by the hinge plates 34 with the sill member 40 is shown at 50 in FIGS. 3*a* and *b*.

Figure 2A:
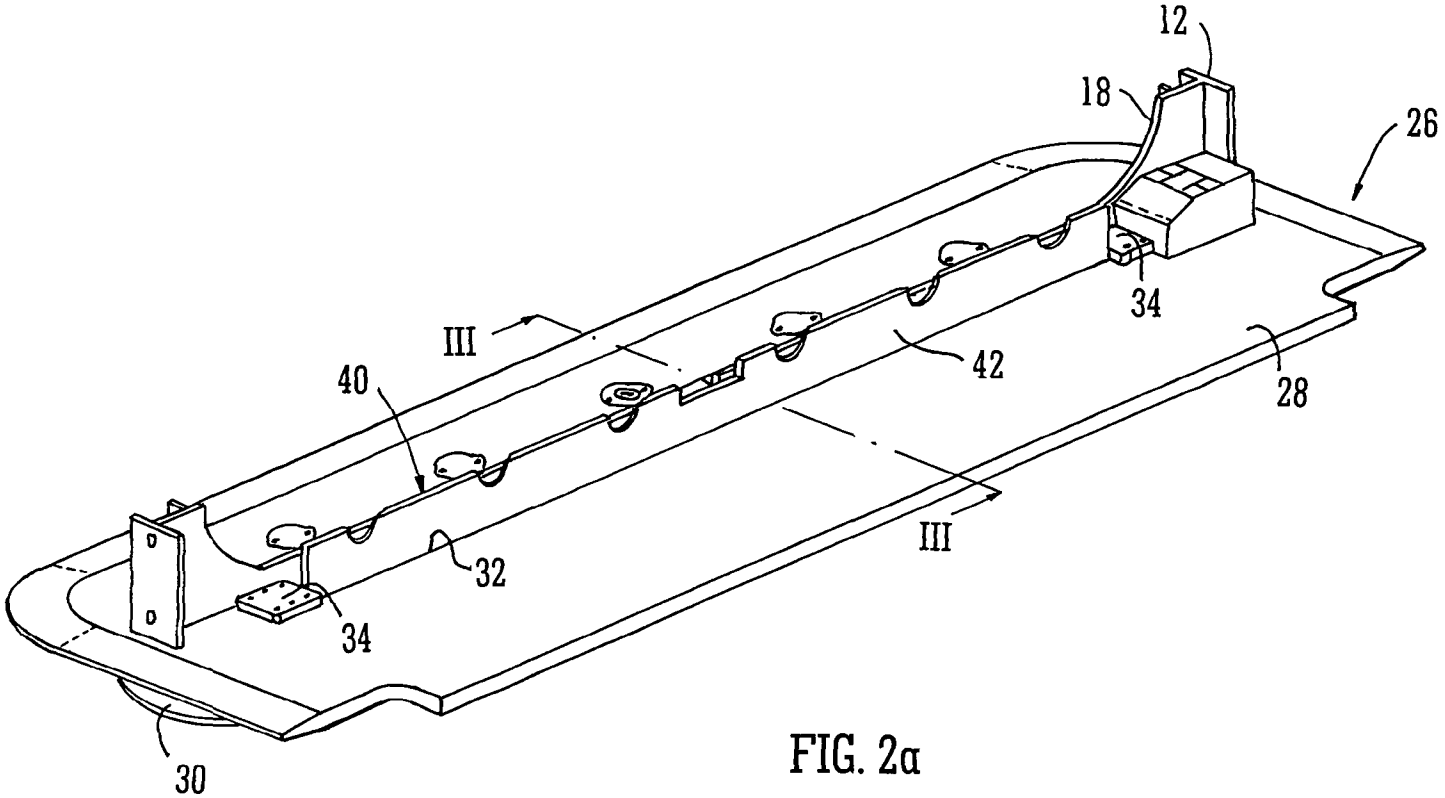
FIGS. 2*a* and *b* are perspective rear and front views respectively of the threshold of the door system shown in FIG. 1.
Figure 2B:
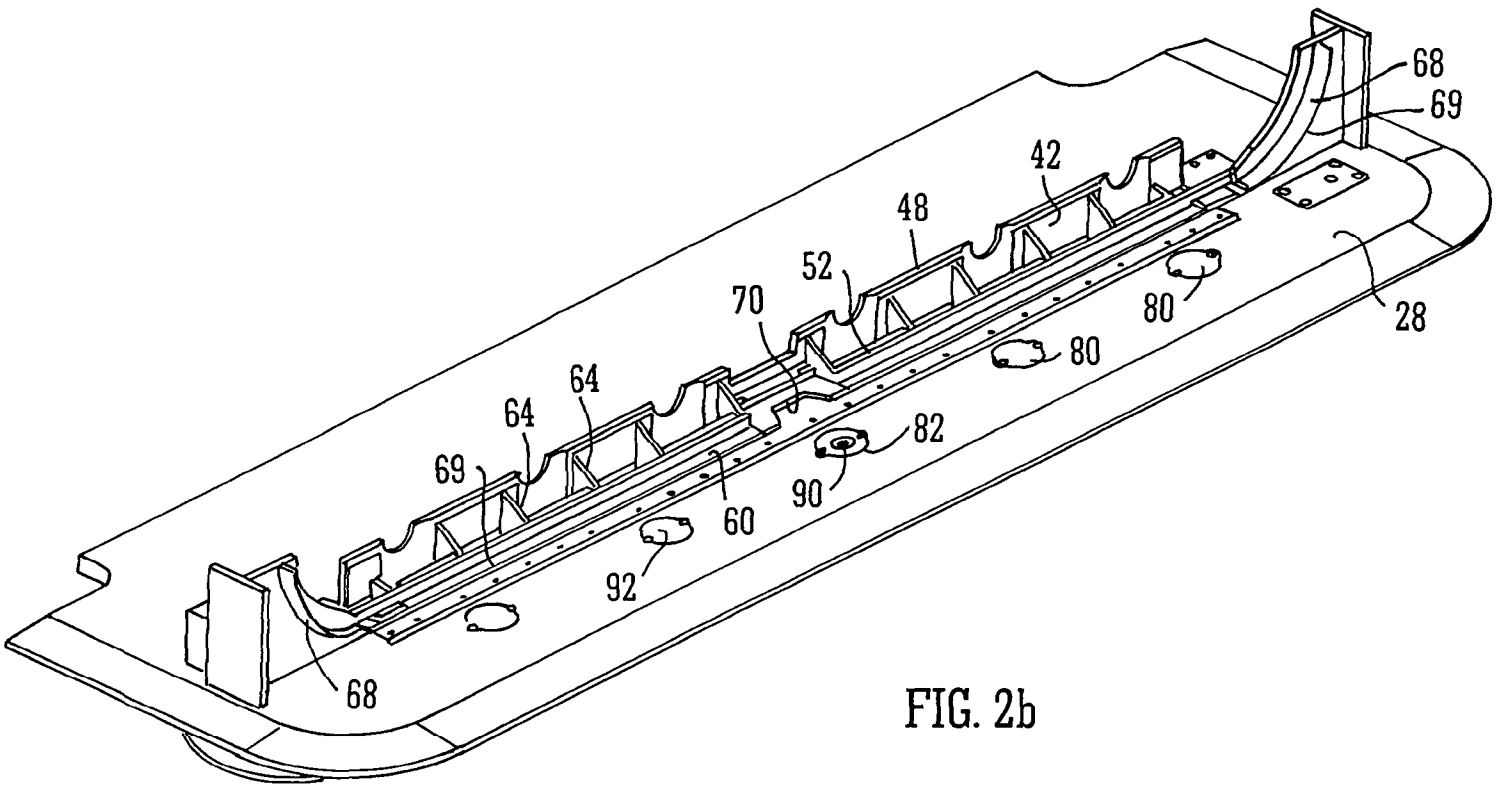
Figure 3A:
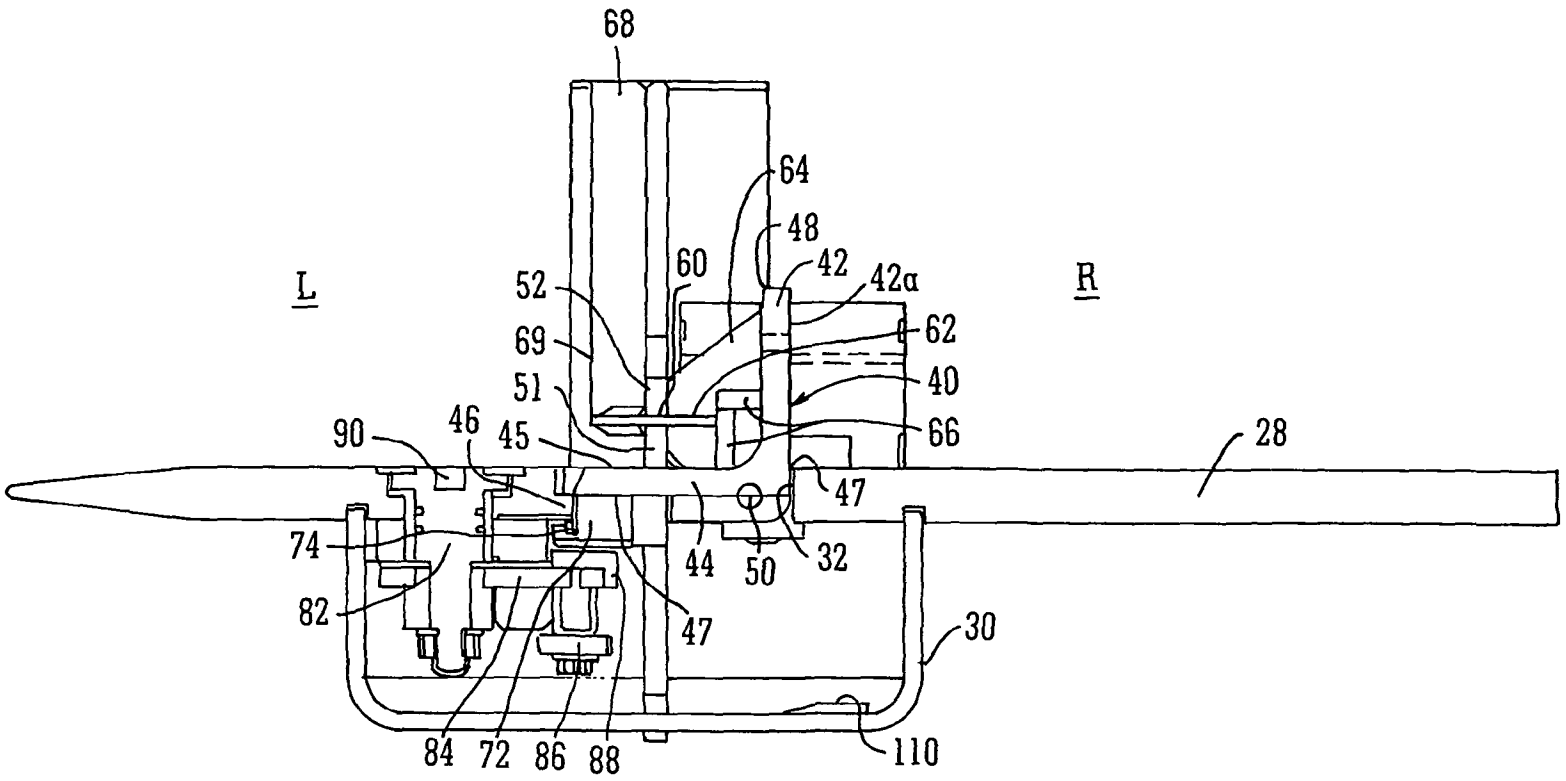
FIGS. 3*a* and *b* are sections in the plane III indicated in FIG. 2*a*, FIG. 3*a* being in a first position of the sill member, and FIG. 3*b* being in its second position.
Figure 3B:
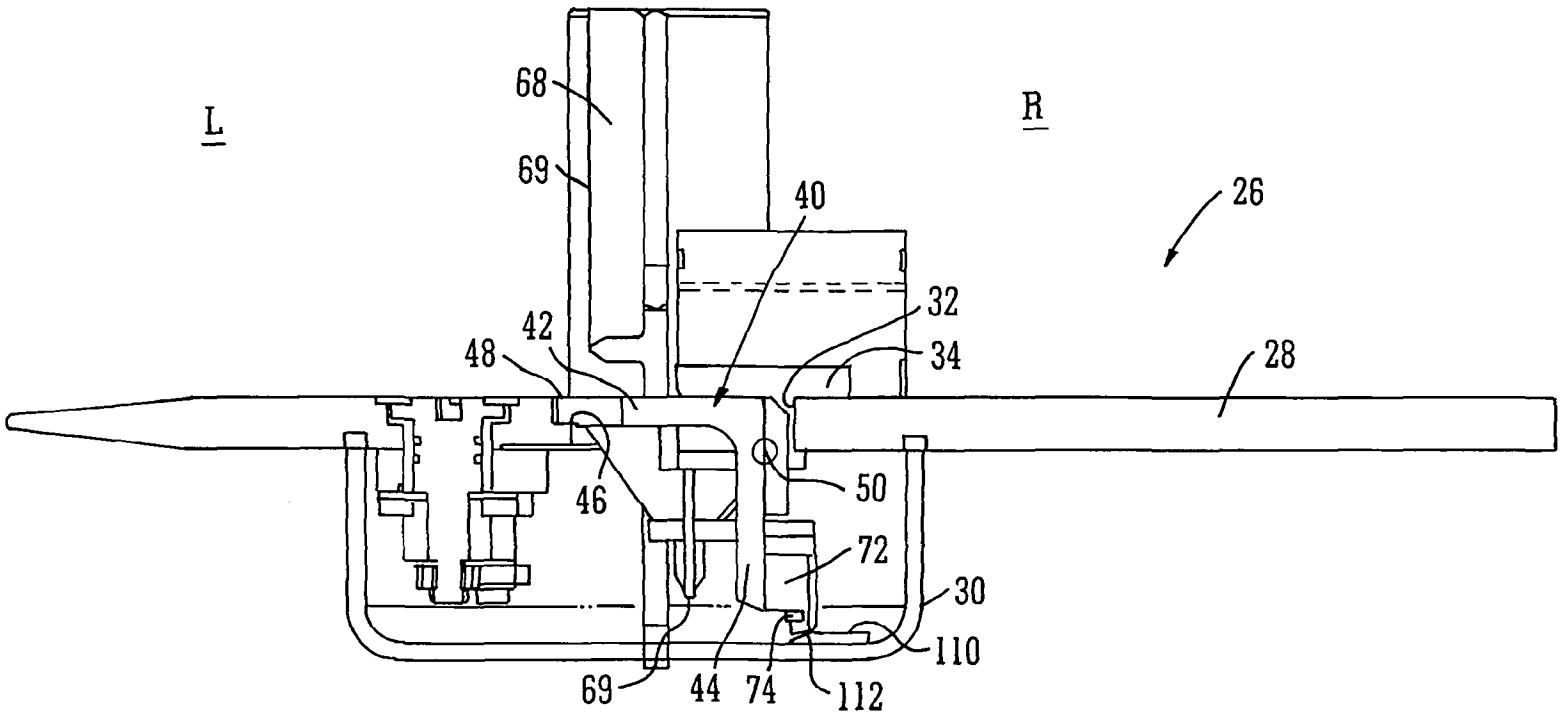
Figure 4:
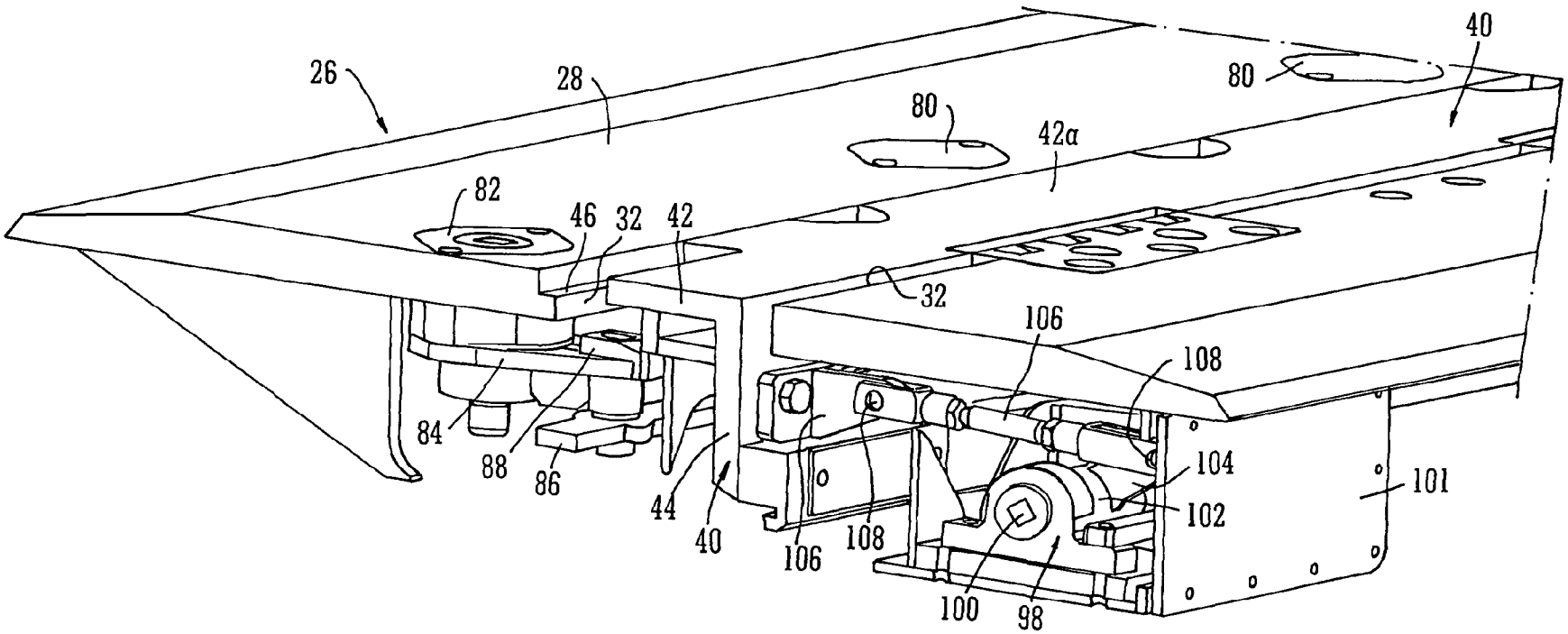
FIG. 4 is a perspective sectional view, slightly offset from the plane of FIG. 3*b;*

The position of the sill member 40 in FIGS. 3*b* and 4 is its second position, its first position being shown in FIGS. 3*a* and 2*a,b* in which the leg 42 is substantially vertical. Referring to FIG. 3*a* in particular, upstanding from back surface 45 of the leg 44 is a support member 51. On the support member 51 is disposed a seal flange plate 60 that is maintained in a horizontal position by being received in slots 62 in a plurality of fillets 64 between the support element 51 and the leg 42. The fillets 64 are spaced along the sill member 40, a further support element 52 being formed on the seal flange 60 and also being supported by the fillets 64. Finally, the back edge of the seal flange 60 is supported by two plates 66 bridging the corner between the legs 42,44 of the L-shaped sill member 40.

The seal plate 60 forms a part of a peripheral seal lip 69 that surrounds the entire door opening 18, but only bottom corners 68 of the seal lip, other than the seal plate 60, is visible in the drawings. The seal lip formed by the seal plate 60 and corners 68, and the remaining lip of the door frame 12, is substantially in the same vertical plane. Accordingly, the door can seal against it and this is achieved by a resilient member forming part of the door 14, but which is not visible in the drawings. An instep 70 is visible in the seal strip 60,68 and this accommodates the central door post 14*c* visible in FIG. 1. However, it should be understood that this is merely one arrangement and the resilient seal element could be disposed on the frame and sill member, with an edge to mate with it being formed on the door.

Thus, apart from forming the contiguous surface 42*a* (see FIG. 4) of the floor plate 28, the primary purpose of the limb 42 of the sill member 44 is to support the seal plate 60. Indeed, functionally, the seal plate 60 is part of the limb 42.

Incidentally, in the first position as shown in FIG. 3*a* the support element 52 is also that part of the doorframe that is latched by the locks 20 at the base of the door 14.

On the underside 47 of the other limb 44 of the sill member 40, is disposed a seal member 72. This includes an elastomeric seal element 74 that seals under ledge 46 of the floor plate 28. Thus, when a door (not visible in FIGS. 2 to 4) is closed against seal edge 69, and seal 74 seals against floor plate 28, a complete seal is provided between sides L and R of the door system 10. Furthermore, the door being closed not only presses the seal strip (not shown) of the door against the edge 69 of the seal plate 60, but it also pulls the seal 74 into contact with the lip 46. Nevertheless, a retention arrangement is provided to keep the sill member 40 in the position shown in FIG. 3*a*, even when the door is opened. As best seen in FIG. 4, a series of pivot blocks 80, (having a central one 82) are disposed in the floor plate 28 adjacent the slot 32. A series of levers 84 are pivoted on the pivot blocks 80,82 and interconnected by a connecting link or bar 86. A brass nose 88 is provided on the end of each lever 84 and, when the sill member 40 is in the first position (shown in FIG. 3*a*), rotation of the levers 84 brings the brass noses 88 under the seal member 72 of the arm 44 of the sill member 40, pressing the seal 74 into engagement with the underside of the ledge 46. Central pivot block 82 is provided with a key hole 90 into which a tool may be inserted to rotate the pivot block 82. Since the pivot blocks are all interconnected by the bar 86, they are rotated together when block 82 is rotated. Consequently, the pivot blocks 80 are closed by top caps 92.

While the sill member 40 may be allowed to pivot freely, when not locked in position, it is feasible for an actuation means to be provided, either mechanically actuated, for example, by a key, or remotely actuated through the use of a solenoid or hydraulic or pneumatic operation. As can be seen in FIG. 4, an actuator 98 is disposed in a side compartment 101 of the trough 30 (see FIG. 1 also). The actuator 98 may be operated by a key 100 or, as just mentioned, by hydraulic, pneumatic or electrical means. Actuator 98 rotates a spindle 102 on which a lever 104 is fixed so as to operate a push rod 106 connected via pivots 108 between the lever 104 and a bracket 106 on the arm 44 of the sill member 40. Rotation of the actuator through a right angle results in a corresponding pivoting of the sill member about its pivot axis 50.

Finally, in the base of the trough 30 is disposed multiple brass supports 110 on which the nose 112 of the seal member 72 rests when in the second position (see FIG. 3*b*). The weight of the sill member 40 and loads imposed on it is then shared between engagement of the arm 42 on the ledge 46 of the slot 32 and engagement of arm 44 through the nose 112 of seal member 72 in the trough 30 via the brass supports 110. Therefore, the pivot hinges 34 need not be designed to accept substantial load.

The position of the axis 50 is selected so that, when the sill member 40 is in the first position (shown in FIG. 3*a*), there is little gap between the corner of the seal member and the adjacent edge 47 of the slot 32, and when the sill member is in the second position (shown in FIG. 3*b*), the back face of the first arm 42 of the sill member is flush with the top of the floor plate 28. This puts the axis 50 close to the edge 47 and somewhat remote from the ledge 46.

Although the displaceable sill member 40 is described above in relation to a watertight door with a complete seal around the door, the arrangement would also be suitable for other doors having a doorstep against which a door abuts when closed, and which step it was desired to remove so that a clear passage is created for wheeled vehicles (especially) passing through the doorway.

Figure 5A:
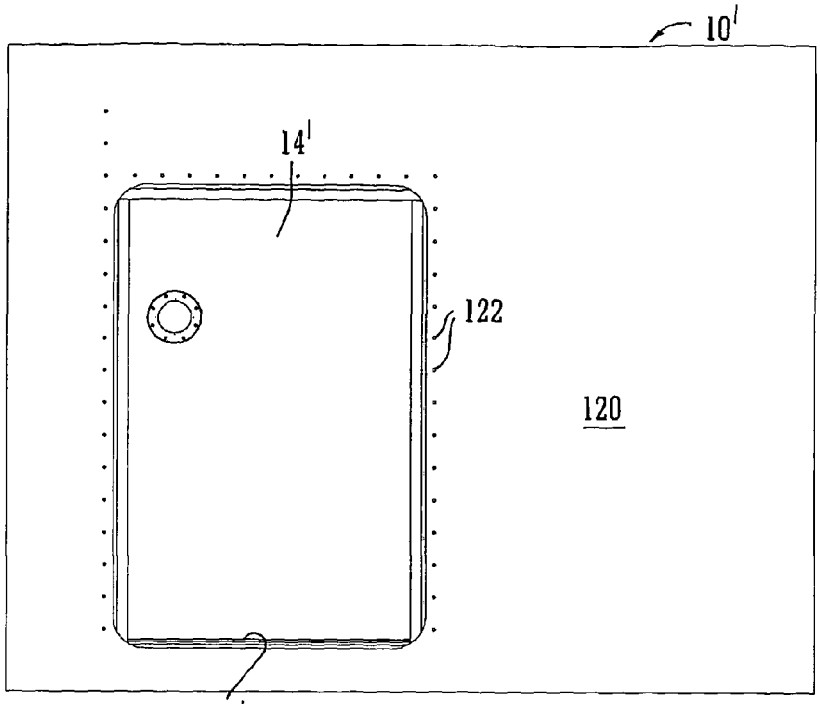
FIG. 5*a* and *b* are front and rear perspective views of a door system according to a second embodiment of the present invention.
Figure 5B:
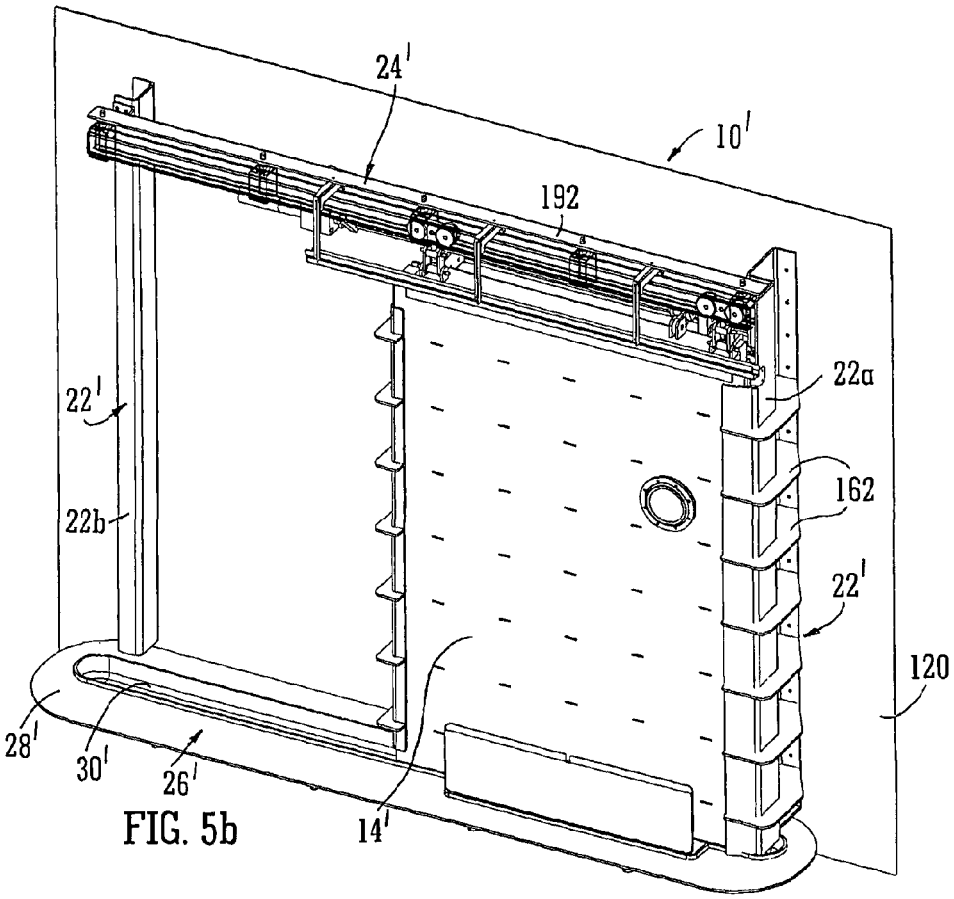

Turning to FIGS. 5*a* and *b*, an alternative door system 10' for a marine vessel is a sliding door and embodies different aspects of the present invention. The system 10' comprises a doorframe 12' and a sliding door 14'. The frame 12' comprises vertical side elements 22', roof element 24' and threshold 26'. One of the side elements is a closed side member 22*a* and the other is an open side member 22*b*. An intermediate side member 22*c* is not visible in FIGS. 5*a* and *b*, but is behind the left-edge of the door 14' (as viewed in FIG. 5*b*).

The frame 12' is designed for connection to a marine vessel bulkhead 120, eg via bolt holes 122, having an opening 18' above a floor (not shown). The bulkhead 120 may be part of a lift shaft, with the floor only extending on the door side of the bulkhead (being the side in the foreground of FIG. 5*b*).

Threshold 26' comprises a floor plate 28' and trough 30' which extends twice the full width of the door 14' and the opening 18' therefor in the bulkhead 120.

With reference to FIGS. 9*a* to *d*, which are all partly in section, the door 14' is a structural element comprising a bulk head skin 124 and a door skin 126. The skins 124,126 are welded together around a periphery 128 defining an edge skin 130. Bracing the skins 124,126 are ribs 132 that are fixed to at least one of the skins 124,126. The bulk head skin 124 defines a rim region 140 of the door 14' by being inset around its periphery at 142. The inset 142 is employed to receive a fire proof panel 144, the structure of which is not relevant to the present invention, save to say that it resists the transmission of heat. However, the rim 140, on the bulk head side, is adapted to effect a seal against a resilient seal element 146 that surrounds the entire opening 18' of the bulk head 120.

Figure 9A:
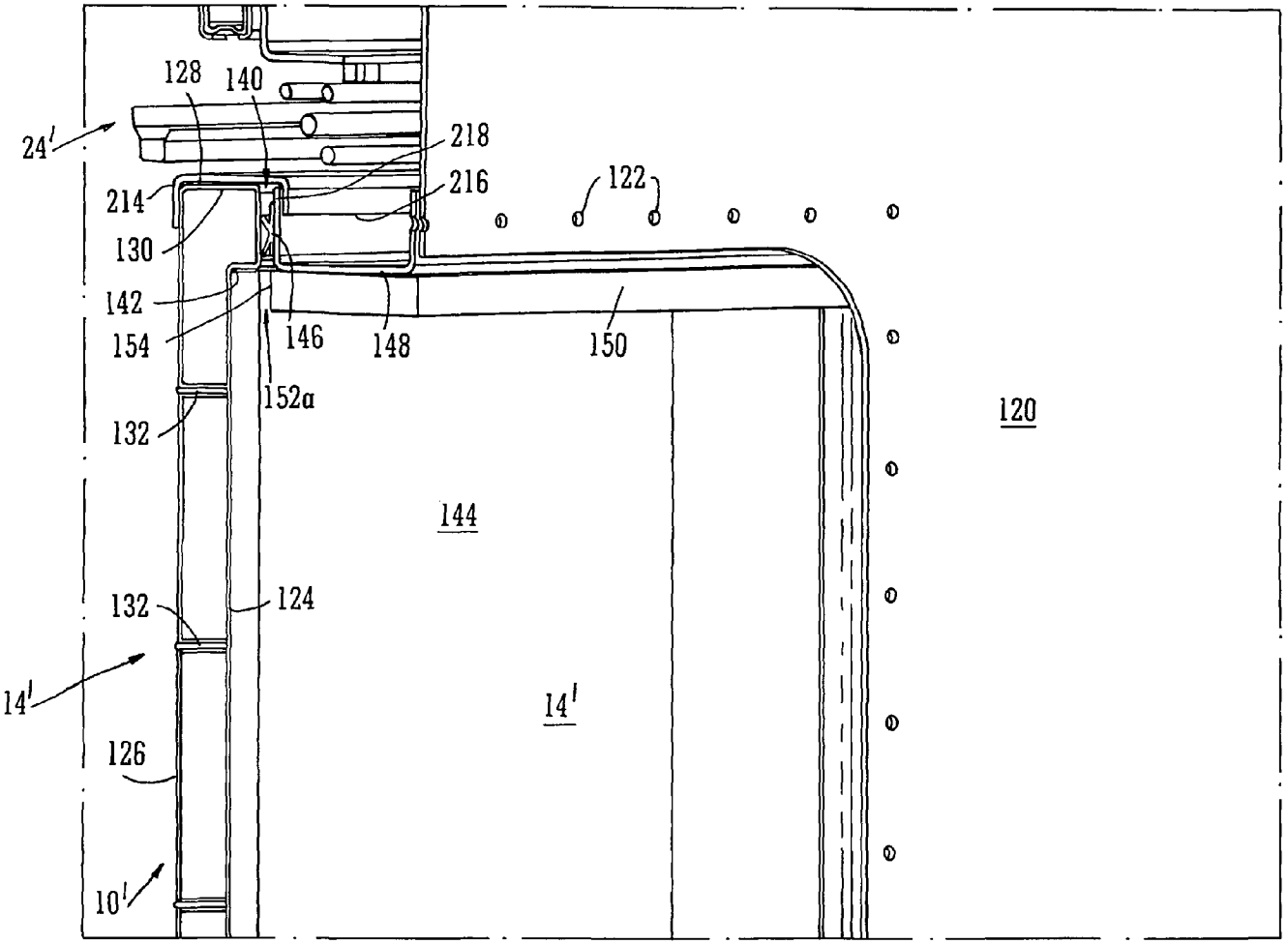
FIGS. 9*a* to *d* are detailed views, partly in section, of the different parts of door system of FIGS. 5*a* and *b*.

Referring first to FIG. 9*a*, seal 146 is attached to a face of top girder 148 forming part of the roof element 24,' and it is to be noted that a further fire proof panel 150 protects the girder 148 from heat in the event of a fire on the bulk head side of the door system 10'. A gap 152*a* is presented between a face of the door board 144 and the edge 154 of the frame board 150. In FIG. 9*a*, this gap is quite large because the door 14' is in its traveling orientation. However, when finally closed (shown only in FIG. 9*d*) the seal 146 is compressed and the gap 152*a* is reduced to a width of only about 2 mm. Over the length of the thickness of the board 150, which is generally about 25 mm, this gap does not represent any opportunity for fire to transmit heat to the seal 146 and significantly disrupt it. Indeed, the IMO standard A60, when applied by a relevant test, leaves the seal still operational and so that the door can still be operated at the end of the test.

Figure 9B:
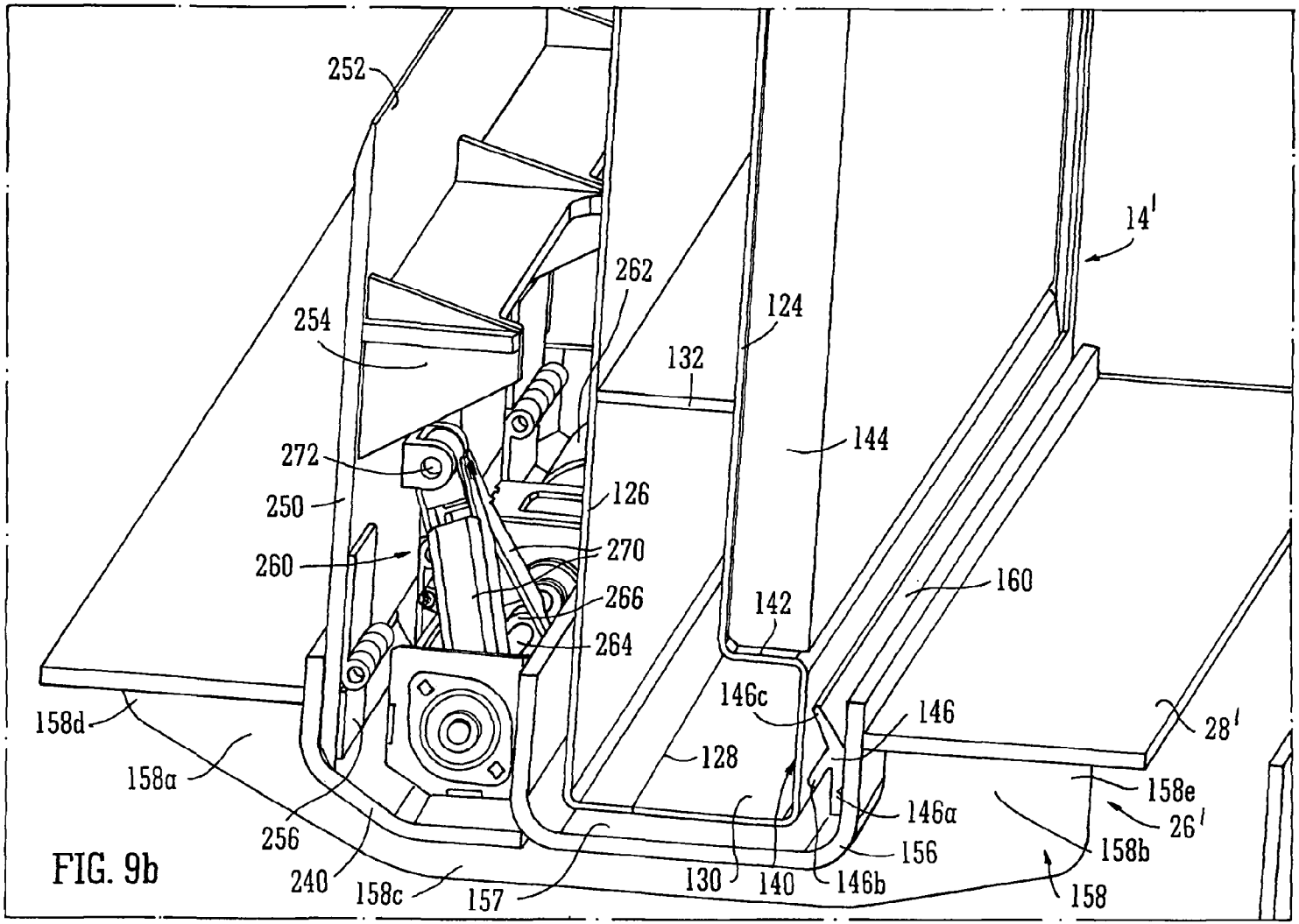

Turning to FIG. 9*b*, the seal 146 is also disposed in a trough girder 156, forming part of the trough 30' in the threshold 26'. A floor plate 28' surrounds the trough girder 156 and the girder and floor plate are braced with a plurality of U-shaped filets 158. These have side legs 158*a,b* and a base 158*c*. The side legs 158*a,b* extend outwardly as arms 158*d,e* to support the floor plate 28'. Thus, when the threshold is incorporated in an aperture (not shown) of a vessel floor, even where the aperture is cut to accommodate the threshold 26', the floor can be rendered as strong and rigid as it was or would be without any aperture.

It is to be noted that the floor plate 28' is beneath the top lip 160 of the girder 156. This is to allow for a floor screed (not shown) to be laid and which is used on marine vessels to protect floors from fire. In any event, fires within the bulk head side space are unlikely to heat the bottom corner of a door opening. Thus a fire is unlikely to affect the seal 146 at this bottom corner.

Figure 9C:
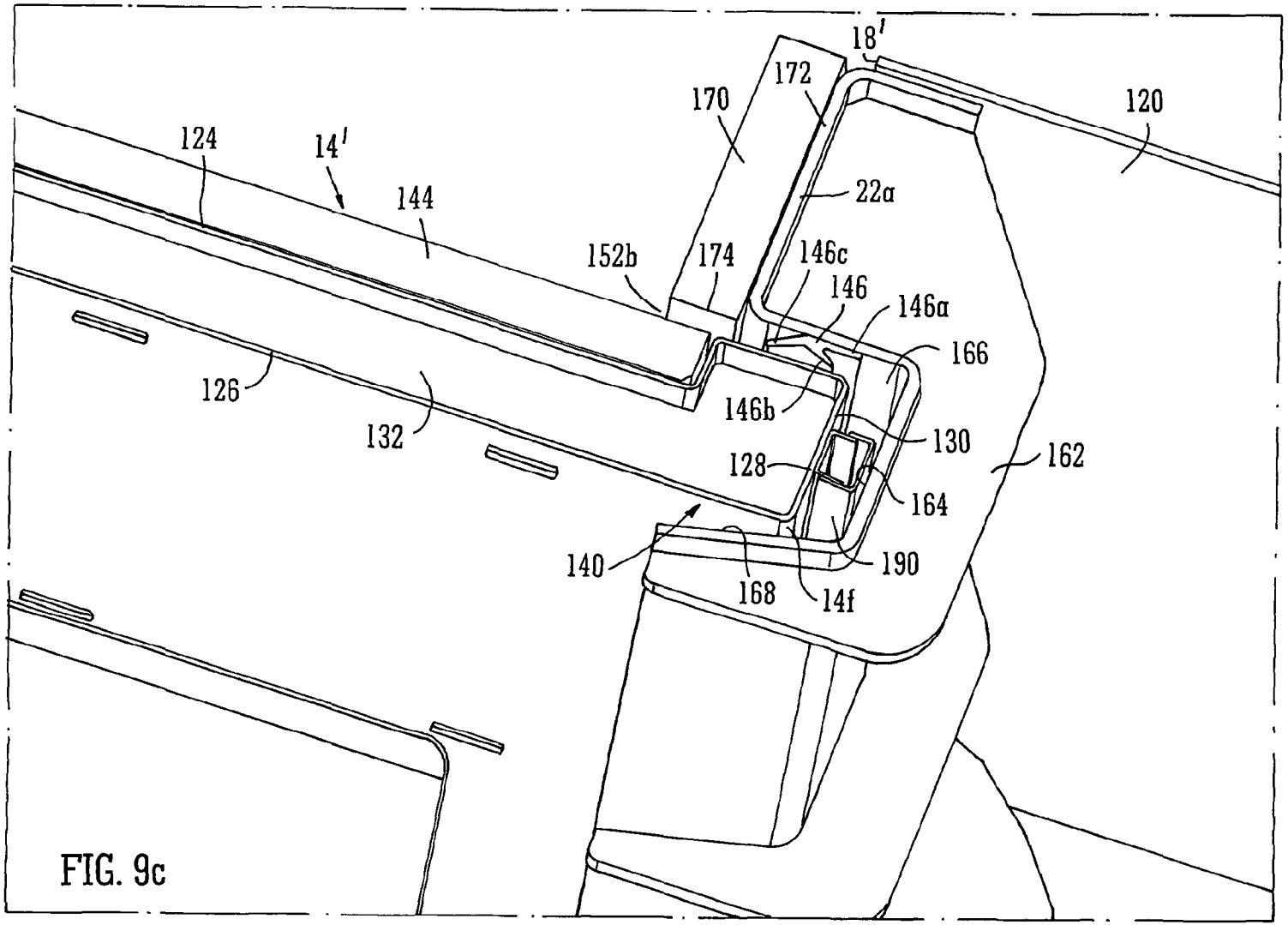
Figure 9D:
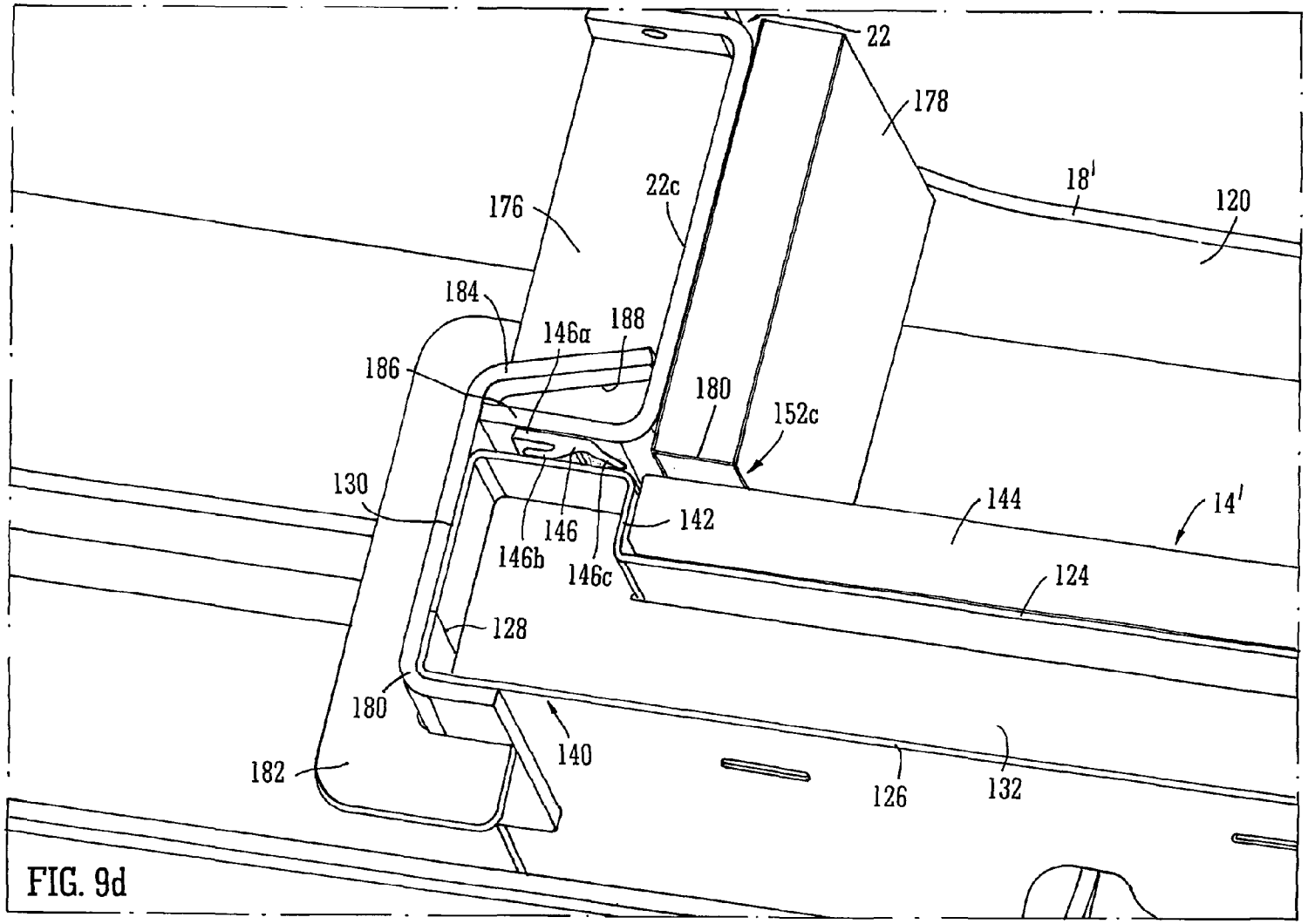

Turning to FIG. 9*c*, side member 22*a* is an S-shaped element (in section) reinforced with a plurality of U-shaped filets 162. The side element 22*a* defines a channel 164 to receive the rim 140 of the door and an inside side 166 carries the resilient seal element 146. The other side 168 of the channel 164 is outwardly inclined, for reasons explained below. A frame board 170 is disposed against the exposed wall 172 of the side frame 22*a* and likewise the edge 174 of the frame board 170 defines a gap 152*b* with the face of the door board 144. Again, this gap is closed when the door reaches its final closing position, described further below. Finally, FIG. 9*d* shows the other side of the door and frame (to that shown in FIG. 9*c*) where the side frame 22' is supplemented by the intermediate side element 22*c* mentioned above. This comprises a channel girder reinforced by a number of filets 176 spaced along the length of the element 22*c*. The side element 22*c* also carries the door seal 146. It also carries a third frame board 178, whose edge 180 likewise defines a gap 152*c* which here, in FIG. 9*d*, it shown in its fully closed position where the seal 146 is compressed. The gap 152*c* is at its corresponding minimum width.

It is to be noted that the seal element 146 is an elastomeric member that has a back wall 146*a* and two inclined front walls 146*b,c*. The rear wall 146*a* is affixed to the surface on which the seal is mounted (that is frame members 22*a,c*, floor girder 156 and roof girder 148). The two front arms 146*b,c* seal against the rim 140 of the door 14' and deflect according to the direction of applied hydrostatic load. That is to say, if the bulk head side of the door 14' is flooded, then lip 146*c* of the seal is pressed ever more tightly against the rim 40; whereas, if the door side of the bulk head 18' is flooded, then it is lip 146*b* that is pressed against the rim 140.

Referring to FIGS. 9*c* and 9*d*, the door 14' is a sliding door (the mechanism of which is described further below) and slides from a leftward, open position to a rightward, closed position, the fully closed position being shown only in FIG. 9*d*. In FIG. 9*d*, a channel section 180 forms part of the door and is attached to the edge skin 130 down the left side of the door 14'. The channel section 180 is supported by U-shaped filets 182 disposed along the length of the door. Side 184 of the channel is open and is inclined outwardly. It serves to catch a lip 186 of the intermediate side element 22*c* when the door is being slid closed, that is, rightwardly in the drawing. Inclined side 184 has a number of slots 188 to accommodate the filets 176 of the side member 22*c*. However, when the inclined open side 184 of the channel section 180 approaches the lip 186, its inner surface catches the lip 186 and begins to draw the door 14' towards the seal 146.

At the same time (see FIG. 9*c*), a front corner 14*f* of the door 14' abuts the inclined side 168 of the side channel 164 and also begins to deflect the door towards the seal 146. Indeed, further cams (not shown) can be included in the inclined faces 168,184 (or, indeed on the door 14' nears its corner 14*f* or on the inside surface of the side 186 of the side element 22*c*) in order to effect the final transverse movement of the door 14' to press it against the seal 146 when it reaches its finally closed position.

When the door is moving from left to right towards its closed position, it has a sensor element 190 (see FIG. 9*c*) that detects obstruction when compressed and prevents further closure. However, it also serves to inform that user when the door reaches its finally closed position when it engages the bottom of the channel 164.

Figure 7A:
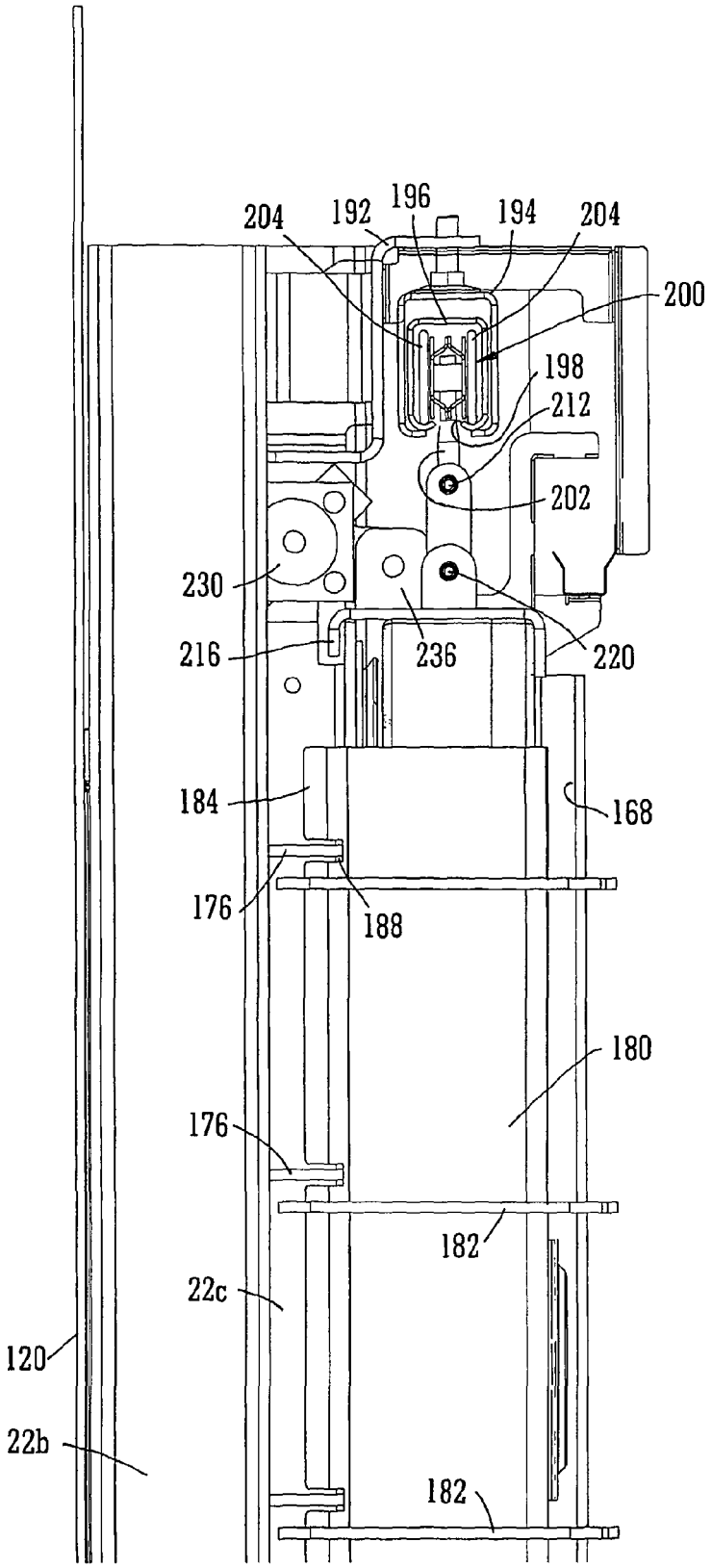
FIGS. 7*a* and *b* are detailed side views of the door system of FIGS. 5*a* and *b.*
Figure 7B:
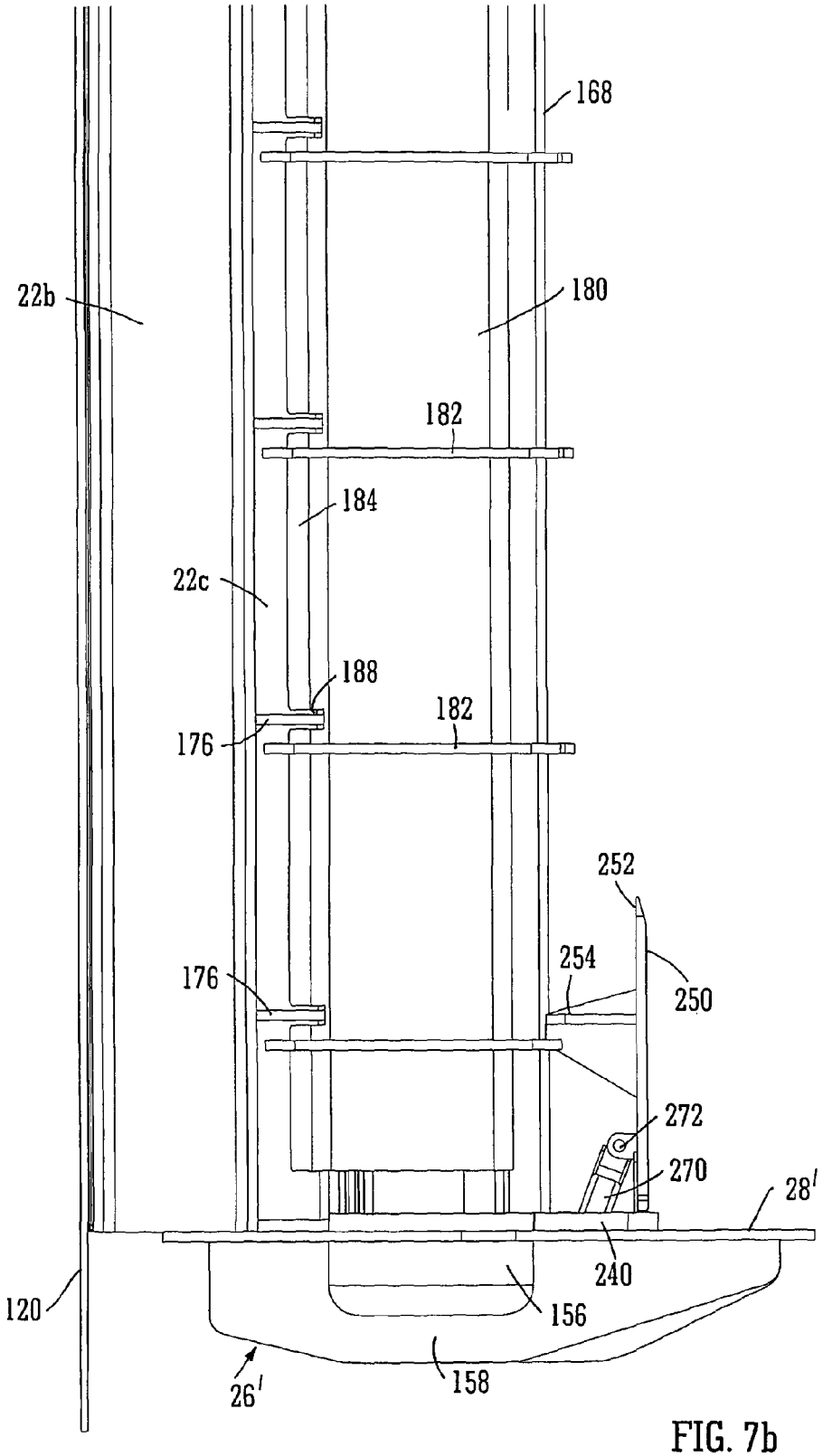
Figure 8A:
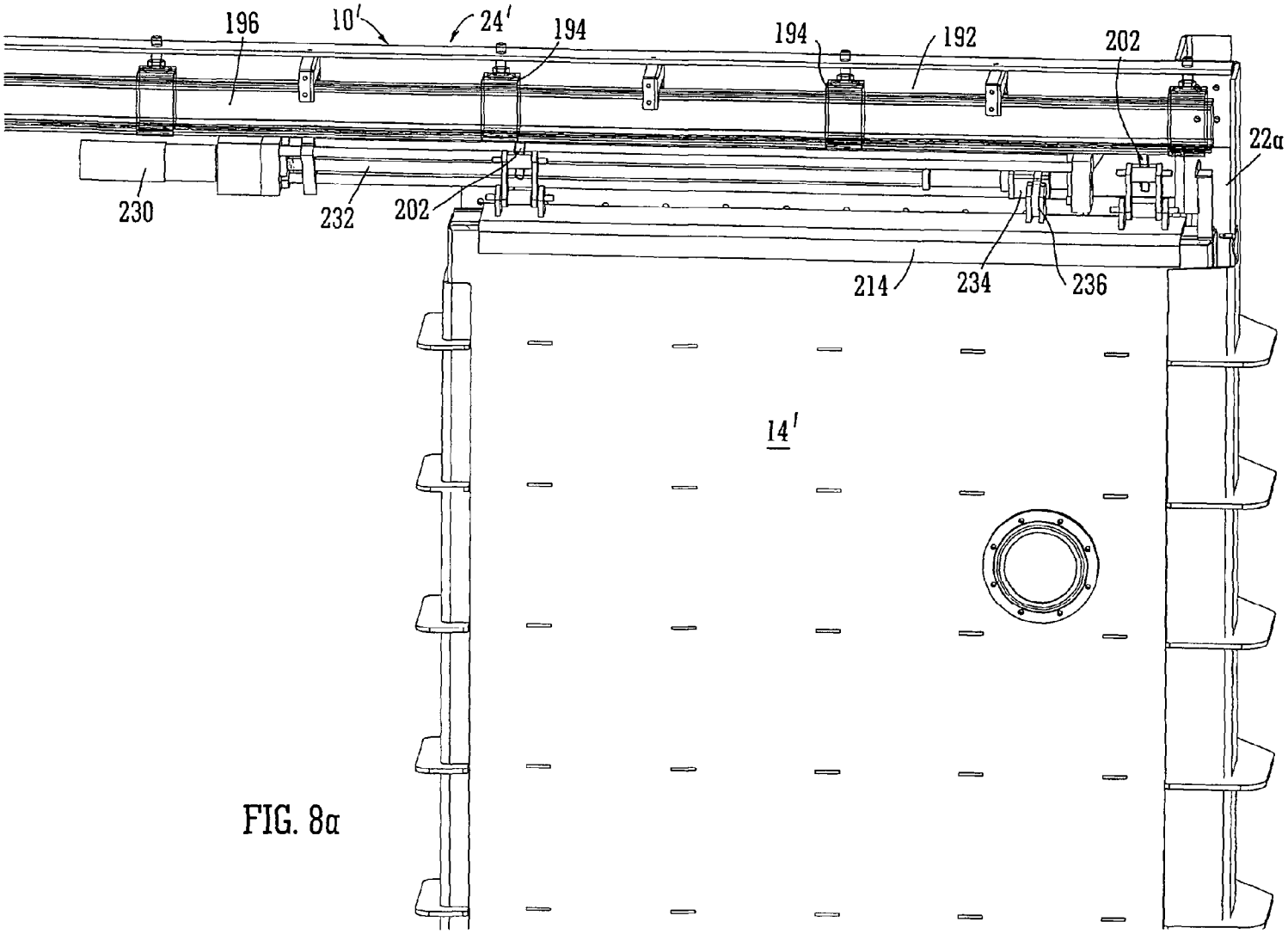
FIGS. 8*a* and *b* are respectively an enlarged side view and a further enlarged detail of a runner of the door system of FIGS. 5*a* and *b*.
Figure 8B:
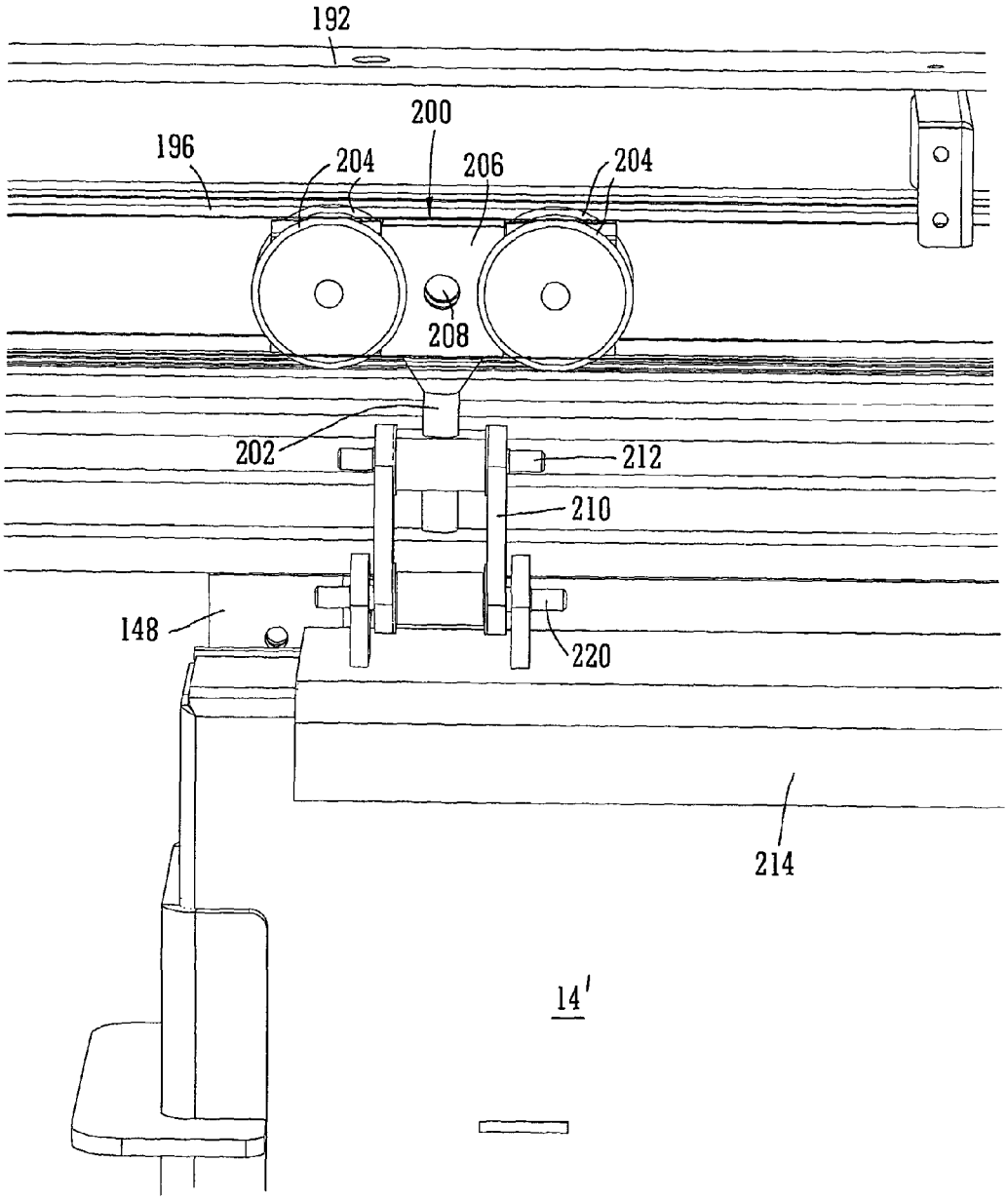

Turning to FIGS. 8*a* and *b*, roof structure 24' comprises the girder 148 described above and connected to the bulkhead 120 and extending between the side frame element 22 *a* and the intermediate element 22*c* (although the girder 148 is only visible in FIG. 8*b*). However, structure 24' also comprises a further Z-shaped girder 192 (see also FIG. 7*a*) that extends the full width of the door system 10' extending between side elements 22*a,b* (only 22*a* being visible in FIG. 8). Depending from girder 192, by brackets 194, is a track 196 that is open underneath through a slot 198 and through which slot support rods 202 of trolleys 200 depend. The trolleys 200 comprise four wheels 204, best seen in FIG. 8*b*, mounted on a body 206 from which the rod 202 is pivoted about axis 208. Rod 202 is connected to a link 210 by a pivot 212, the link 210 being itself connected to the door 14' via top channel section 214 fixed to the door. Indeed, the channel 214 has an open inside lip 216 that captures free edge 218 of the roof girder 148 (see FIG. 9*a*). The link 210 is connected to the top girder 214 via pivot 220 and the combined pivots 212, 220 and link 210 enable lateral movement of the door 14' when it engages the inclined channel side 168 and its own inclined channel side 184 engages the lip 186.

Two of said trolleys 200 and depending supports of the door 14' are provided, one at each end of the door and the weight of the door is entirely supported by the trolleys 200 within the track 196.

In FIG. 8*a*, a motor 230 is visible, which is supported fixedly from the top frame element 192. The motor drives a threaded spindle 232. The spindle 232 extends through a nut 234 connected to a bracket 236 attached to girder 214 of the door 14'. Thus, by driving the motor 230, the door is translated leftwardly or rightwardly, being supported by the trolleys 200 in the tracks 196.

Figure 6A:
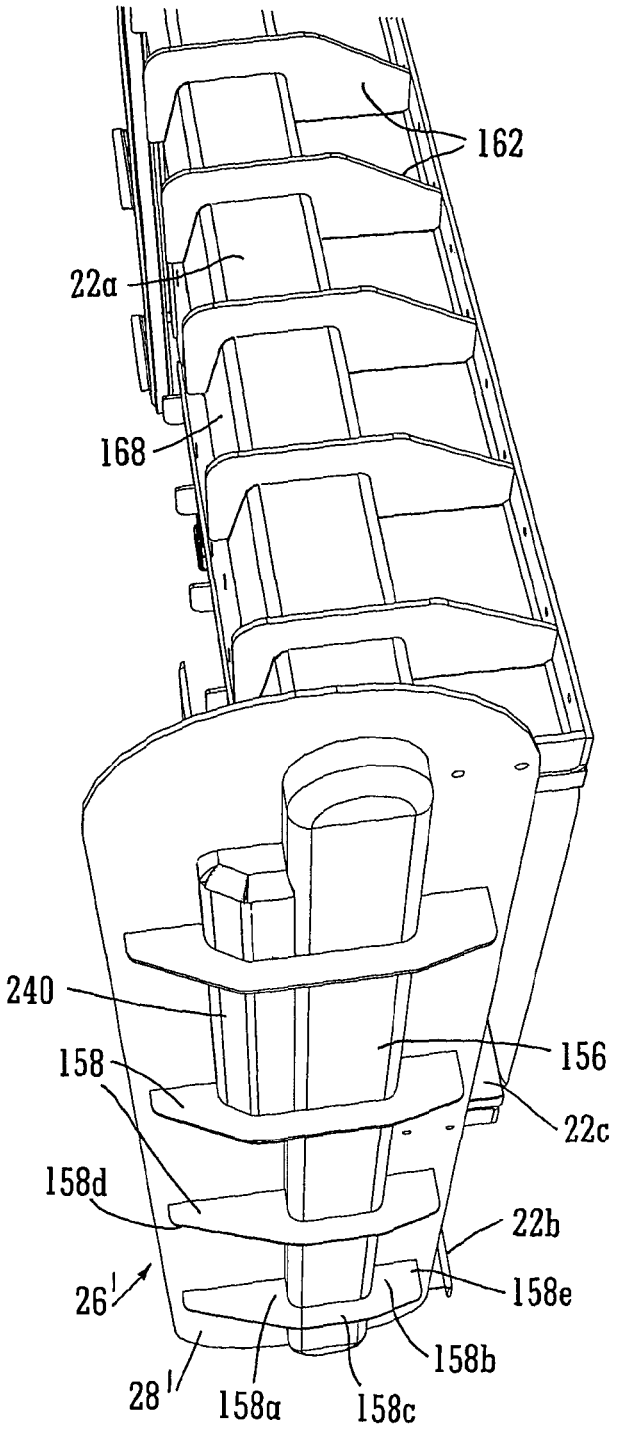
FIGS. 6*a* and *b* are top and underneath views of the doorplate of the door system of FIGS. 5*a* and *b;*
Figure 6B:
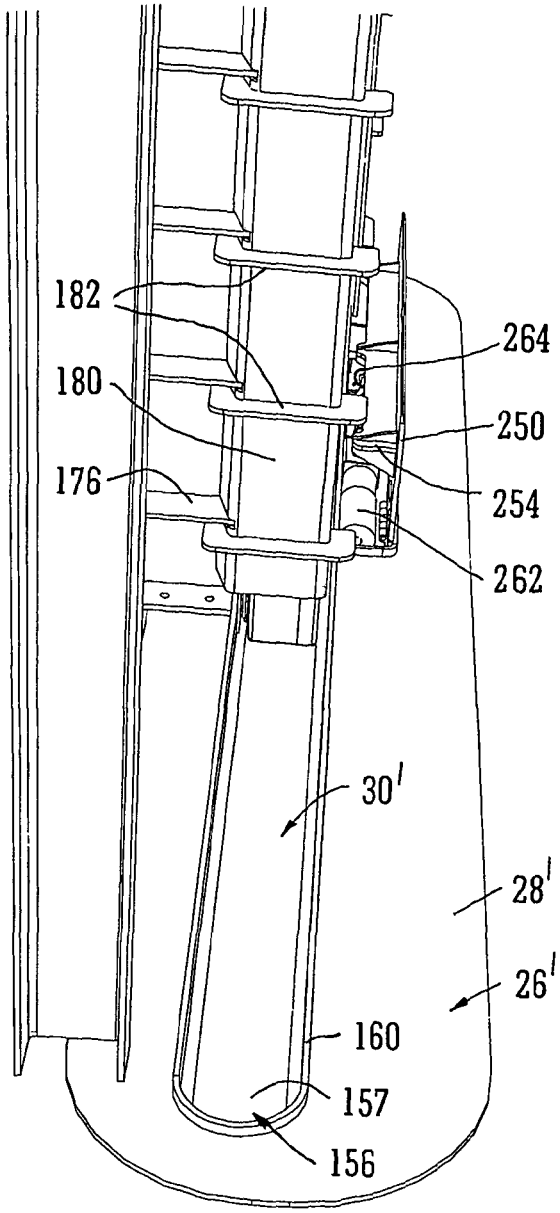

FIGS. 6*a* and *b* illustrate the threshold 26' and its floor plate 28' and supporting filets 158. Also, the trough 30' is visible in FIG. 6*b*. However, also visible in FIG. 6*b* is a lid receptacle 240 that, with the channel girder 156 completes the trough 30'. The lid receptacle 240 houses a lid 250 (see also FIG. 9*b*). When the door is closed, or being moved towards its closed position, the lid 250 must be in the open position, as shown in the drawings. However, when the door is moved to its fully open position, then the lid 250 can be pivoted to a closed position in which it closes the top of trough 30' comprising the channels 156,240. A lip 252 of the lid 250 is adapted to overlie top edge 160 of the girder 156. Depending support legs 254 support the lid 250 when in its closed position by resting on floor 157 of the trough girder 156. The lid 250 is hinged to the lid trough 240 by hinges 256 and it is actuated by jack system 260. Jack system 260 comprises a motor 262 that rotates a lead screw 264 and about which are threaded nuts 266 (only one of which is visible in the drawings) of a pair of scissor legs 270. The scissor legs 270 are pivoted to the lid 250 about pin 272.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A door system for connection to a bulkhead of a structure around an aperture in the bulkhead above a floor of the structure, the system comprising:

a) a frame adapted for connection to the bulkhead and comprising two sides, a top member and a floor trough;

b) a door comprising a structural panel and having a bulkhead side adapted in use to face the bulkhead and having an opposing door side facing away from the bulkhead; and c) a circumferential seal between the frame and door;

d) wherein the door is against the frame when the door is in closed position thereof;

e) said trough comprises a floor plate substantially flush with a top edge of the trough, which floor plate is adapted to form a floor panel of the floor of the structure with said trough received in an aperture of the floor, the trough comprising a lid to close the trough at least when the door is in an open position so that the floor is rendered substantially level through the door aperture; and wherein the seal extends into the trough a east when the door is in an open position.

2. The door system of claim 1, wherein the trough includes a channel for receipt of a bottom edge of the door, which in this event opens by sliding in said channel.

3. The door system of claim 1, wherein the door opens by pivoting on hinges.

4. The door system of claim 3, wherein the seal at least in part is on the lid and is split along its length between being disposed between the lid and the door and between the frame and the door.

5. The door system of claim 4, wherein the frame-side seal on the lid and frame align when the lid is open.

6. The door system of claim 1, wherein the trough and floor plate are reinforced so that they can integrate with the floor of the vessel without compromising the integrity of the structure of the floor.

7. The door system of claim 6, wherein said trough is reinforced by a plurality of U-shaped plate fillets welded to the trough and spaced along its length.

8. The door system of claim 7, wherein the fillets have side legs joined by a base to form said U-shape.

9. The door system of claim 8, wherein the plate fillets are also welded to the floor plate adjacent the trough and also reinforce the floor plate.

10. The door system of claim 9, wherein the U-shape is modified by arms that extend horizontally from the free ends of the legs.

11. The door system as claimed in claim 1, in which said floor plate defines a floor plane of the door system, in which said lid constitutes a sill member of the threshold and includes a door seal; in which the bulkhead side of said door has a face to press against the door seal in a first direction, said sill member being pivotable in the trough about an axis transverse said first direction between a first position in which the door, when closed, seals against the sill member door seal and a second position, in which the sill member does not extend above said floor plane.

12. The door system of claim 11, in which said sill member has said door seal in a front-face thereof, an opposite back face lying in said floor plane in said second position.

13. The door system of claim 12, in which the trough is sealed to the floor plate around the entire periphery thereof.

14. The door system of claim 11, in which said sill member is shaped in section, a first arm comprising said front and back faces and a second arm comprising a floor seal which, in said first position forms a seal against a seal face of the threshold.

15. The door system of claim 14, in which both said seals are in the angle of the L-shaped sill member, said front face of the sill member having a top edge which, in said second position, lies on an edge of the threshold slot opposite the seal face of the threshold.

16. The door system of claim 14, in which said sill member is pivotable about an axis aligned with the joint between said first and second arms.

17. The door system of claim 11, in which a selectively operable lock is operable to lock the sill member in said first position.

18. The door system of claim 17, in which said sill member is L-shaped in section, a first arm comprising said front and back faces and a second arm comprising a floor seal which, in said first position forms a seal against a seal face of the threshold and in which said selectively operable lock presses the second arm and its floor seal against the threshold seal.

19. The door system of claim 18, in which said selectively operable lock comprise a plurality of pivot blocks received in said floor plate adjacent said slot on the side thereof remote from said pivot axis of the sill member, each pivot block having a support lever pivotable under said second arm.

20. The door system of claim 19, in which at least one of said pivot blocks is actuable by a tool, the levers being interconnected by a pivot link whereby actuation of one pivot block actuates them all.

21. The door system of claim 11, in which closure of the door against the sill member serves to hold the sill member in said first position.

22. The door system of claim 11, in which a selective operator is provided in the floor plate to pivot the seal member between said positions.

23. The door system of claim 22, in which said selective operator comprises a jack disposed in said trough.

24. The door system of claim 11, in which the door includes lock devices that press the door against the sill member, said lock devices pressing on said opposite back face.

25. The door system of claim 11, in which a door seal is provided all around the door to render the door watertight when closed, the sill member forming a part of said door seal when in said first position.

26. The door system of claim 25, in which said door seal lies substantially in a single plane.

27. The door system of claim 11, in which said door seal comprises an edge of one of said door and door frame and a resilient face of the other of said door and door frame.

28. The door system of claim 27, in which said edge is an edge of a flange of the door frame and sill member.

29. The door system of claim 28, in which the edge of the sill member is a seal plate that is supported on a support element upstanding from said second arm and positioned by a plurality of fillets disposed between said first arm and said support element, the fillets being slotted to receive said seal plate.

30. The door system of claim 29, in which a further support element is disposed on the seal plate and also supported by said fillets, said lock devices operating against said further support element.

31. The door system of claim 1, in which the structure is a marine vessel and the door system forms a watertight door.

32. A door system for connection to a marine vessel bulkhead around an aperture in the bulkhead, the system comprising:

a) a frame adapted for connection to the bulkhead and comprising two sides, a top member and a floor trough;
b) a door comprising a structural panel and having a bulkhead side adapted in use to face the bulkhead and an opposing door side facing away from the bulkhead;
c) the top member including a track having depending supports of the door;
d) a side channel on a first side of the frame;
e) a lip on the second side of the frame;
f) the door having a first side edge adapted to engage said side channel when the door is slid along said track to a closed position of the door;
g) the door having a door channel around its second edge, which channel is open on the bulkhead side of the door, whereby the open door channel engages said lip when the door is slid along said track to said closed position of the door;
h) a circumferential seal between the door and the frame; and
i) a cam to press the door against the frame to effect the seal, the cam being operated when the door is slid along said track to said closed position of the door; and wherein
j) said side channel and door channel are reinforced so as to accommodate pressure loads on the bulkhead side of the door tending to push the door off the seal.

33. The door system of claim 32, wherein said side channel and door channel are each reinforced by a plurality of U-shaped plate fillets welded around the outside of the channel at spaced locations along each channel.

34. The door system of claim 33, wherein said channels each have at least one inclined side edge that constitutes said cam.

35. The door system of claim 34, wherein the door channel has said inclined edge on the side of the channel that engages said lip when the door slides towards its closed position, so that, when said lip engages said inclined side, the door channel and door are together drawn towards the frame to effect said seal.

36. The door system of claim 34, wherein the side channel has said inclined edge on a side of the channel that engages said side edge of the door when the door slides towards its closed position, so that, when said side edge engages said inclined side, the door is drawn towards the frame to effect said seal.

37. A door system for connection to a marine vessel bulkhead around an aperture in the bulkhead above a floor of the vessel, the system comprising:

a) a frame adapted for connection to the bulkhead and comprising two sides, a top member and a floor trough;
b) a door comprising a structural panel and having a bulkhead side adapted in use to face the bulkhead and an opposing door side facing away from the bulkhead;
c) the top member including a track having depending supports of the door; and a circumferential seal on one of the door and frame adapted to engage the other of the frame and door, wherein
d) said structural panel comprises a bulkhead skin, a door skin spaced from the bulkhead skin and an edge skin extending around the door, reinforcing ribs bracing said bulkhead and door skins against one another;
e) a rim, including said edge skin, around the edge of the door panel and defining both the width of the door and at least a bulkhead face of the rim, which face is of a width sufficient to overlie said seal;

said bulkhead skin is inset within said rim to receive a fire resistant door board; and g) said sides and top member of the frame have fire resistant frame boards whose edges are adjacent said seal when the door is slid along said track to said closed position of the door and are adapted to define with said door board an inaccessible heat path.

38. The door system of claim 37, wherein the thickness of said frame boards, that define the length of the inaccessible heat path, are preferably at least 20 mm.

39. The door system of claim 37, wherein the frame boards extend around the sides and top of the frame only.

40. The door system of claim 32, wherein the seal is adapted to seal against hydrostatic pressure on either side of the door.

41. The door system of claim 40, wherein the seal includes a resilient element having a back surface for fixation of the seal element against the frame or door and two depending lips adapted to engage the bulkhead side of the door or the frame, one lip extending in a direction that resists hydrostatic pressure from the bulkhead side of the door and the other lip extending in a direction that resists hydrostatic pressure from the door side of the door.

42. The door system of claim 41, wherein the resilient seal element is fixed to the frame and the door has a peripheral rim for engagement with the seal.

43. A watertight door system for a marine vessel around an aperture in a bulkhead above a floor of the vessel, the system comprising a door and a door frame having a threshold, a circumferential seal around an opening of the door frame closed by the door, which seal is formed between seal components of the door and seal components of the door frame, an upstanding flange of the threshold forming a part of the seal components of the door frame, said flange being selectively displaceable between an operable position in which the door and door frame seal components can seal against one another to render the door watertight and an open position in which said threshold has a substantially flush top surface, the system further comprising:

a) the frame being adapted for connection to the bulkhead and comprising two sides, a top member and a floor trough;

b) the door comprising a structural panel and having a bulkhead side adapted in use to face the bulkhead and an opposing door side facing away from the bulkhead;

c) the top member including a track having depending supports of the door;

d) a side channel on a first side of the frame;

e) a lip on the second side of the frame;

f) the door having a first side edge adapted to engage said side channel when the door is slid along said track to a closed position of the door;

g) the door having a door channel around its second edge, which channel is open on the bulkhead side of the door, whereby the open door channel engages said lip when the door is slid along said track to said closed position of the door;

h) a circumferential seal between the door and the frame; and i) a cam to press the door against the frame to effect the seal, the cam being operated when the door is slid along said track to said closed position of the door; and wherein j) said side channel and door channel are reinforced so as to accommodate pressure loads on the bulkhead side of the door tending to push the door off the sea.

44. The door system of claim 43, further comprising:

a) a circumferential seal between the frame and the door;

b) wherein the door is against the frame when the door is in a closed position thereof; and c) said trough comprises a floor plate substantially flush with a top edge of the trough, which floor plate is adapted to form a floor panel of the floor of the structure with said trough received in an aperture of the floor, the trough comprising a lid to close the trough at least when the door is in an open position so that the floor is rendered substantially level through the door aperture.

45. A watertight door system for a marine vessel around an aperture in a bulkhead above a floor of the vessel, the system comprising a door and a door frame having a threshold, a circumferential seal around an opening of the door frame closed by the door, which seal is formed between seal components of the door and seal components of the door frame, an upstanding flange of the threshold forming a part of the seal components of the door frame, said flange being selectively displaceable between an operable position in which the door and door frame seal components can seal against one another to render the door watertight and an open position in which said threshold has a substantially flush top surface, the system further comprising:

a) the frame being adapted for connection to the bulkhead and comprising two sides, a top member and a floor trough;

b) the door comprising a structural panel and having a bulkhead side adapted in use to face the bulkhead and an opposing door side facing away from the bulkhead;

c) the top member including a track having depending supports of the door; and a circumferential seal on one of the door and frame adapted to engage the other of the frame and door, wherein d) said structural panel comprises a bulkhead skin, a door skin spaced from the bulkhead skin and an edge skin extending around the door, reinforcing ribs bracing said bulkhead and door skins against one another;

e) a rim, including said edge skin, around the edge of the door panel and defining both the width of the door and at least a bulkhead face of the rim, which face is of a width sufficient to overlie said seal;

f) said bulkhead skin is inset within said rim to receive a fire resistant door board; and g) said sides and top member of the frame have fire resistant frame boards whose edges are adjacent said seal when the door is slid along said track to said closed position of the door and are adapted to define with said door board an inaccessible heat path.

46. The door system of claim 45, further comprising:

a) a circumferential seal between the frame and the door;

b) wherein the door is against the frame when the door is in a closed position thereof; and c) said trough comprises a floor plate substantially flush with a top edge of the trough, which floor plate is adapted to form a floor panel of the floor of the structure with said trough received in an aperture of the floor, the trough comprising a lid to close the trough at least when the door is in an open position so that the floor is rendered substantially level through the door aperture.

* * * * *